US009287614B2

(12) United States Patent
Vahidpour et al.

(10) Patent No.: US 9,287,614 B2
(45) Date of Patent: Mar. 15, 2016

(54) MICROMACHINED MILLIMETER-WAVE FREQUENCY SCANNING ARRAY

(75) Inventors: Mehrnoosh Vahidpour, Santa Clara, CA (US); Kamal Sarabandi, Ann Arbor, MI (US); Jack East, Ann Arbor, MI (US); Meysam Moallem, Ann Arbor, MI (US)

(73) Assignee: The Regents Of The University of Michigan, Ann Arbor, MI (US)

( * ) Notice: Subject to any disclaimer, the term of this patent is extended or adjusted under 35 U.S.C. 154(b) by 833 days.

(21) Appl. No.: 13/600,570

(22) Filed: Aug. 31, 2012

(65) Prior Publication Data

US 2015/0263429 A1 Sep. 17, 2015

Related U.S. Application Data

(60) Provisional application No. 61/529,376, filed on Aug. 31, 2011.

(51) Int. Cl.

| | |
|---|---|
| ***H01Q 13/10*** | (2006.01) |
| ***H01Q 1/36*** | (2006.01) |
| ***H01Q 13/18*** | (2006.01) |
| ***H01Q 13/20*** | (2006.01) |
| ***H01Q 21/00*** | (2006.01) |
| ***H01Q 21/06*** | (2006.01) |

(52) U.S. Cl.

CPC ..... *H01Q 1/36* (2013.01); *H01Q 13/10* (2013.01); *H01Q 13/18* (2013.01); *H01Q 13/203* (2013.01); *H01Q 21/0037* (2013.01); *H01Q 21/065* (2013.01)

(58) Field of Classification Search

CPC ..... H01Q 13/10; H01Q 13/103; H01Q 13/18
USPC ..... 343/770, 771
See application file for complete search history.

(56) References Cited

U.S. PATENT DOCUMENTS

| | | | | |
|---|---|---|---|---|
| 5,264,859 | A * | 11/1993 | Lee et al. | 343/754 |
| 6,947,003 | B2 * | 9/2005 | Huor | 343/770 |
| 8,446,313 | B2 * | 5/2013 | Miyagawa et al. | 342/175 |
| 8,599,090 | B2 * | 12/2013 | Yamaguchi et al. | 343/770 |
| 8,610,633 | B2 * | 12/2013 | Chen et al. | 343/771 |

* cited by examiner

*Primary Examiner* — Brian Young
(74) *Attorney, Agent, or Firm* — Harness, Dickey & Pierce, PLC

(57) ABSTRACT

A frequency scanning traveling wave antenna array is presented for Y-band application. This antenna is a fast wave leaky structure based on rectangular waveguides in which slots cut on the broad wall of the waveguide serve as radiating elements. A series of aperture-coupled patch arrays are fed by these slots. This antenna offers 2° and 30° beam widths in azimuth and elevation direction, respectively, and is capable of ±25° beam scanning with frequency around the broadside direction. The waveguide can be fed through a membrane-supported cavity-backed CPW which is the output of a frequency multiplier providing 230~245 GHz FMCW signal. This structure can be planar and compatible with micromachining application and can be fabricated using DRIE of silicon.

19 Claims, 30 Drawing Sheets

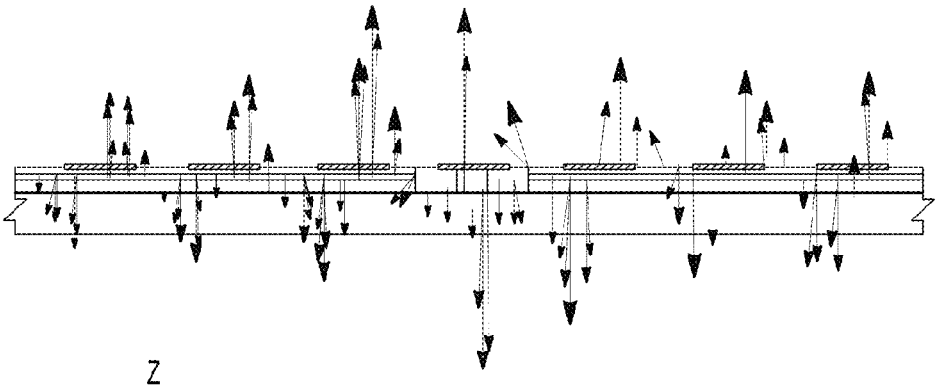
Fig-14B
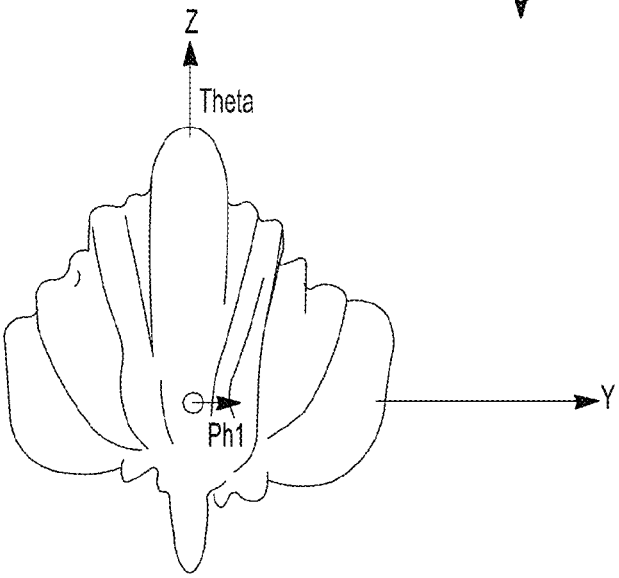
Fig-14C
Fig-14D
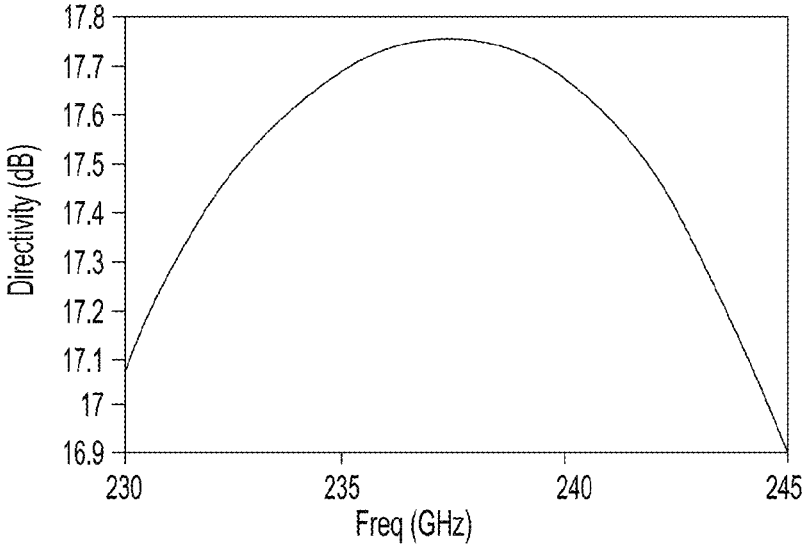

MICROMACHINED MILLIMETER-WAVE FREQUENCY SCANNING ARRAY

CROSS-REFERENCE TO RELATED APPLICATIONS

This application claims the benefit of U.S. Provisional Application No. 61/529,376, filed on Aug. 31, 2011. The entire disclosure of the above application is incorporated herein by reference.

GOVERNMENT INTEREST

This invention was made with government support under Grant No. W911 NF-08-2-0004 awarded by the U.S. Army Research Office. The government has certain rights in the invention.

FIELD

The present disclosure relates to a micromachined millimeter wave frequency scanning array.

BACKGROUND AND SUMMARY

This section provides background information related to the present disclosure which is not necessarily prior art. This section provides a general summary of the disclosure, and is not a comprehensive disclosure of its full scope or all of its features.

Due to the increased potential applications in the areas of wireless communication systems, imaging systems, atmospheric studies, autonomous vehicle control, perimeter security, and the like, millimeter wave (MMW) range received extensive attention over the past decades. In this region, the wavelength is short enough to allow fabrication of compact size radars compatible with Monolithic Microwave Integrated Circuit (MMIC) chips and achieve higher resolution. Yet, at the same time, the wavelength is long enough at the lower band to allow signal penetration through environment with low visibility, such as smoke or fog, with little or no attenuation. MMW radar is also able to function in adverse weather conditions compared to optical sensors, such as lasers. On the other hand, since the small atmospheric particles, such as raindrops, can no longer be considered small compared to the wavelength at higher MMW bands, MMW radars have been extensively used for the remote sensing of clouds, snow covered vegetation, and the like.

Although the atmospheric absorption increases at higher frequencies, current activities in MMW region have focused on measuring across extremely short distances below 100 meters or so and therefore, in most cases, have been able to exclude any serious absorption on backscattering effects. In addition, the available bandwidth at each principal window of MMW band is extremely large, resulting in many advantages such as higher data rate and range resolution.

Recent demands for very high resolution radars highlighted the need for developing new methods for low-cost MMW radars. It is desirable to devise a means of providing electronic, rather than mechanical, beam scanning in order to reduce system complexity and cost. It is especially important to eliminate the use of gimbals because they are slow, bulky and susceptible to mechanical failure and because they experience strong mechanical forces that sharply limit the scanning speed. On the other hand, electronic beam steering radars are fast but rather expensive and power inefficient, requiring several Watts of power. In addition, the incorporated phase shifters are bulky and in most cases not available at higher MMW band.

Considering these limitations, a traveling-wave frequency scanning approach is the simplest method of beam steering if enough bandwidth is available for the radar operation. In a traveling-wave frequency scanning antenna array, scanning is achieved as a result of the frequency dependence of the complex propagation constant of the wave propagating inside the waveguide. Principally, elements are fed in series with a transmission line having appropriate delay line segments between two adjacent elements. The delay lines are equal in length and provide the progressive phase difference among the array elements. As the frequency is swept, the delay lines provide different values for the phase difference and cause beam steering. At the center frequency, delays are designed to keep all elements in phase, and the radiation is in the broadside direction. Taking advantage of transmission lines to generate the desired phase shift eliminates the need to use electronic phase shifters which require additional power to operate, and reduces the cost of the device. Moreover, the problem of connecting the miniature MMIC chip to the external antenna is solved because the phase shifters and radiating elements are now in one unit and can be fabricated on a single substrate.

Travelling-wave antennas are designed based on either dielectric materials which result in slow wave radiation or hollow structures which result in fast wave radiation. In upper MMW spectrum, excessive conductor loss in the complex feeding networks is a major problem. In addition, printed transmission lines, such as microstrip, require very thin substrates to avoid exciting surface waves. Construction of scanning arrays based on hollow waveguide structures proves to be convenient because it provides enough bandwidth, does not incorporate dielectric materials, yet presents high power handling capabilities and lower loss, especially at higher frequencies, compared to planar transmission lines. In these travelling-wave structures, the length of the waveguide provides the desired phase shift, while the radiation is through slots cut on the walls of the waveguide making it a leaky wave structure. Another advantage of the hollow waveguides is they are light weight, which makes them attractive when a large structure, like an array, is required. This feature especially finds applications in Micro Autonomous Systems and Technology (MAST) when the antenna should be mounted on a mobile platform. Moreover, at higher frequencies, as the dimensions of the lines and waveguides shrink, micromachining offers easy fabrication of complex structures with low cost and low mass.

There have been several attempts to fabricate W-band waveguides with low-cost microfabrication techniques, such as lithography. However, in these techniques, the height of the waveguide is limited by the maximum thickness of the spun photoresist, limiting the fabrication to the reduced-height waveguides which suffer from high attenuation. Taking advantage of the "snap-together" technique, a rectangular waveguide was fabricated in two halves and then the halves were put together to form a complete waveguide. An alternate technique to etch the waveguide is deep reactive ion etching (DRIE) of silicon. Unlike wet etching, which is dependent on the crystal planes of silicon, DRIE is anisotropic and provides vertical sidewalls. Hence, DRIE is a viable approach for fabrication of high-performance micromachined waveguide structure. In some cases, a feed transition using microfabrication processes with separately fabricated and assembled probes has been reported for both diamond and rectangular waveguide. Another high-precision silicon micromachined transition with a capability to integrate filters has been proposed and shows wideband characteristics at the same frequency range. A very simple transition from cavity-backed co-planar waveguide (CBCPW) to rectangular waveguide for micromachining applications has been proposed and tested in Ka-band.

According to the principles of the present teachings, a two-dimensional micromachined meander-line frequency scanning array using WR-3 rectangular waveguide is presented for Y-band applications. This structure is capable of achieving ±25° scanning around the broadside angle. A narrow 2° beamwidth is achieved in the azimuth direction using linear array of slots cut on the broad wall of the waveguide. Employing hybrid-coupled patch arrays, a fixed beam can be realized to present a fairly narrow beamwidth in the elevation direction as well. The waveguide is fed through a membrane-supported cavity-backed co-planar waveguide (CPW), which is the output of a frequency multiplier providing 230~245 GHz FMCW signal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1A is a rectangular waveguide with slots cut on the broad wall. This structure cannot provide broadside radiation without grating lobes. The scanning range is also limited.

Figure 2:
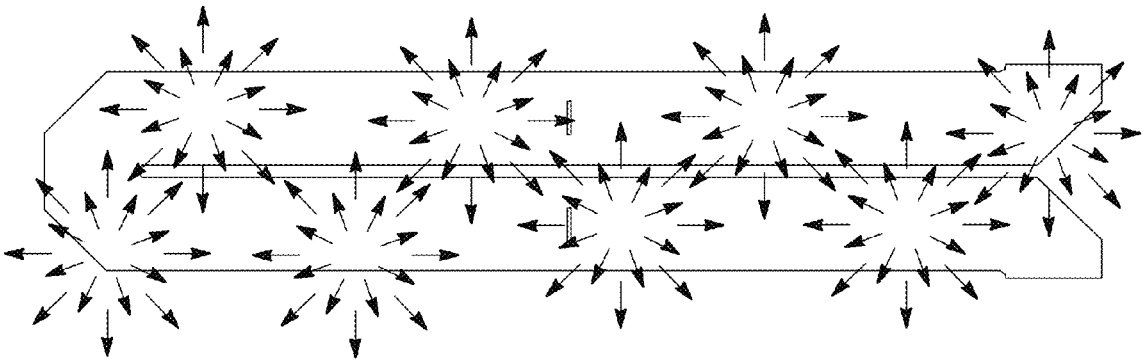

FIG. 2 shows the current distribution on the broad wall of the rectangular waveguide. The direction is reversed after the waveguide is bent. It should be compensated by adding a $\lambda_{g0}/2$ waveguide segment.

Figure 3A:
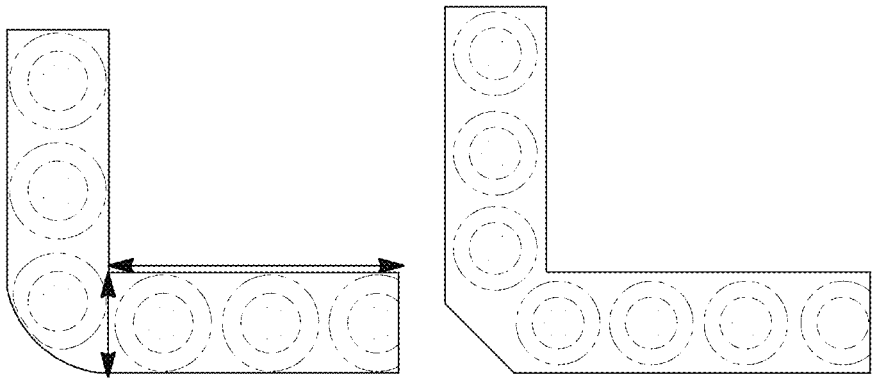

FIG. 3A shows an electric field distribution inside the waveguide for curved and diagonal cut bends.

Figure 3B:
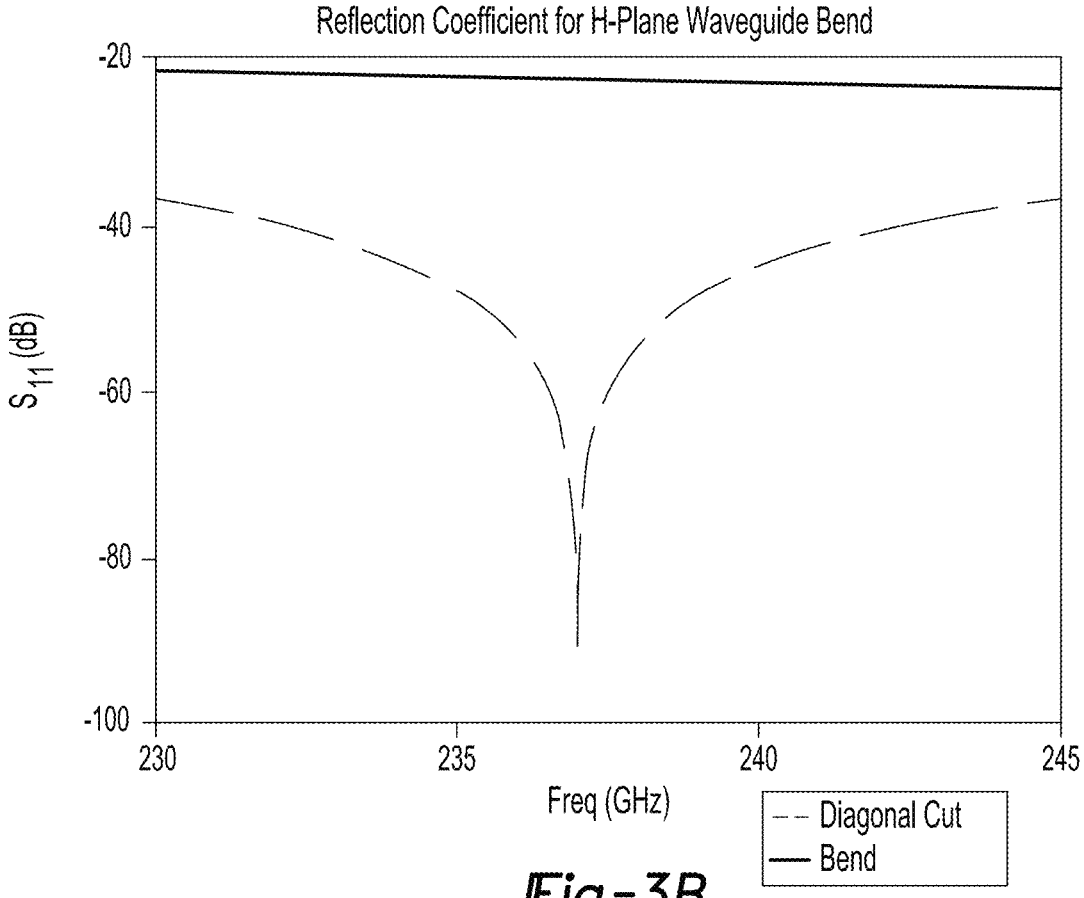

FIG. 3B shows a reflection coefficient from the bends. The diagonal cut bend is 45° and $l_b$=0.85 mm.

Figure 4A:
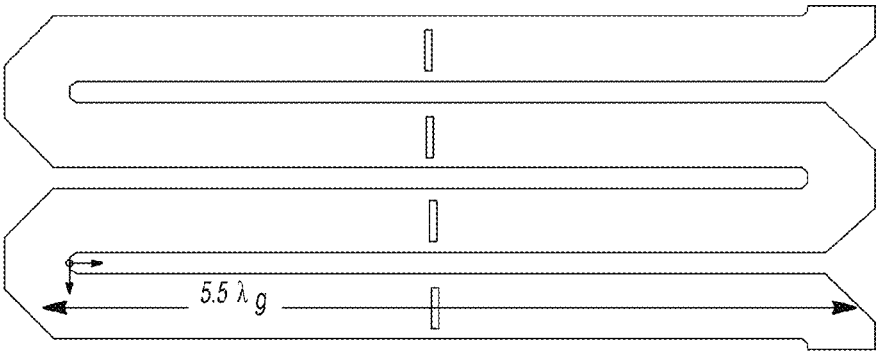

FIG. 4A shows the unit cell of the meander-line structure with 250 μm separating walls optimized for minimum reflection at the beginning and end of the band.

Figure 4B:
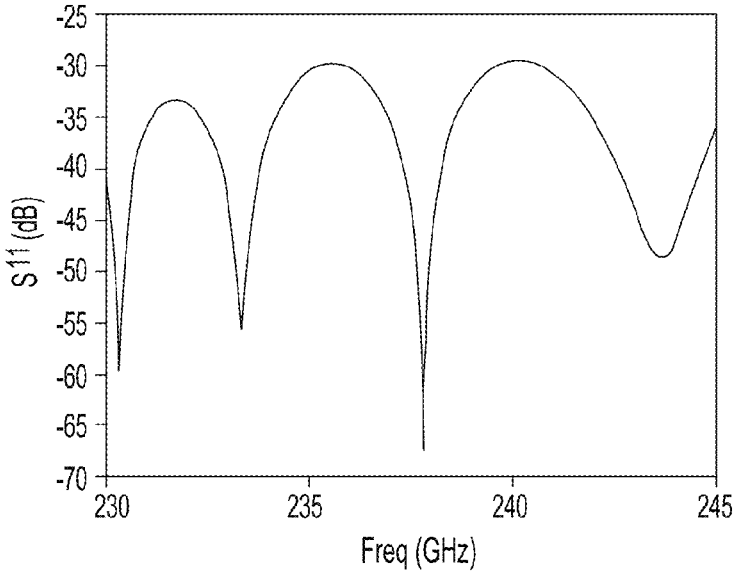

FIG. 4B shows the reflection coefficient for the unit cell.

Figure 4C:
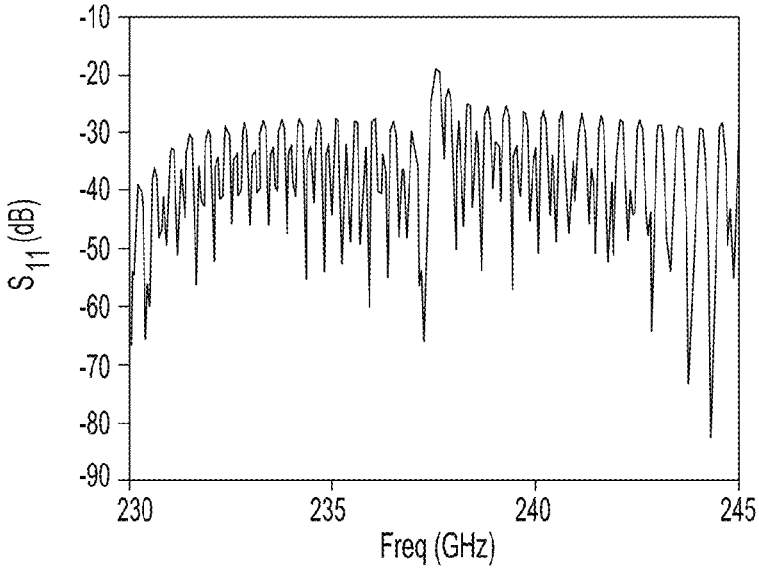

FIG. 4C shows the reflection coefficient for nine unit cells.

Figure 5A:
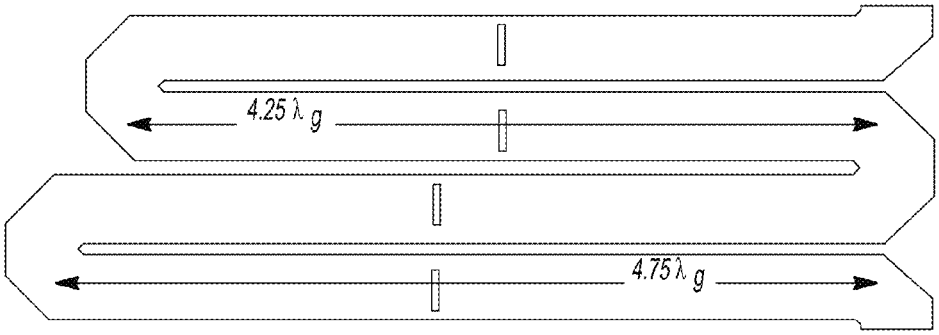

FIG. 5A shows the unit cell of the meander-line structure optimized for minimum reflection at the center frequency with 50 μm separating walls.

Figure 5B:
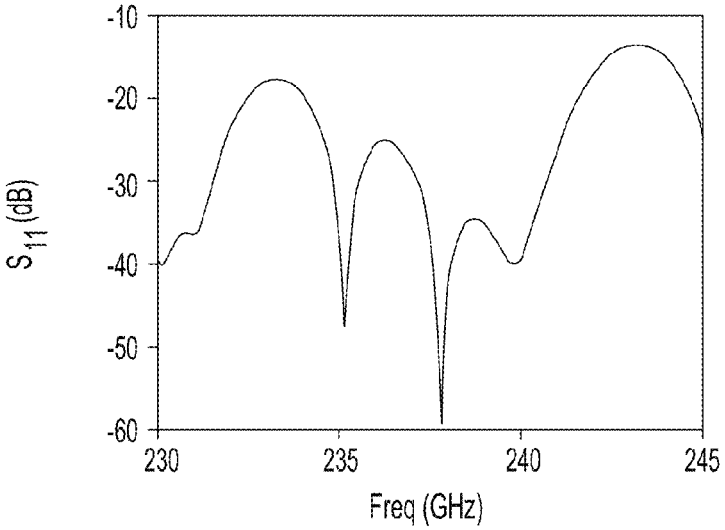

FIG. 5B shows the reflection coefficient for the unit cell. It is minimized for the center frequency.

Figure 5C:
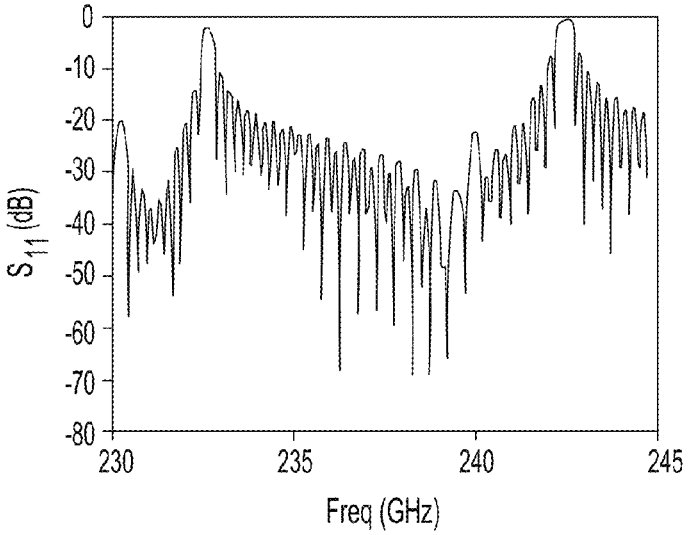

FIG. 5C shows the reflection coefficient for nine unit cells. The constructive interference at some other frequencies causes a high reflection.

Figure 6A:
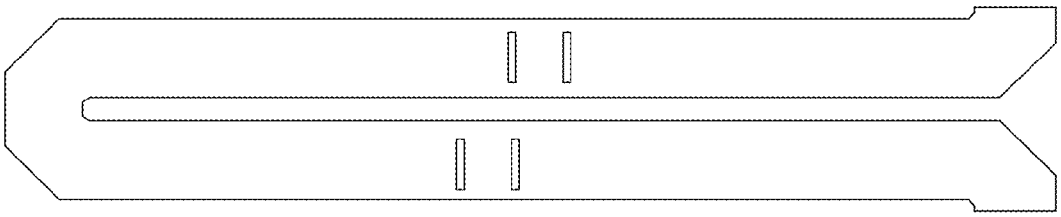

FIG. 6A shows a unit cell with reflection cancelling slot.

Figure 6B:
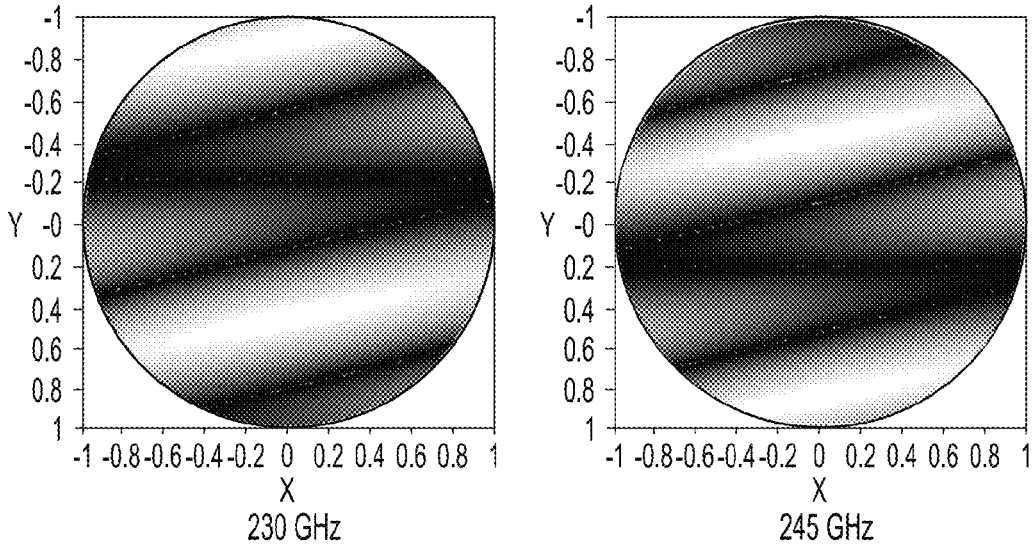
Figure 6B:
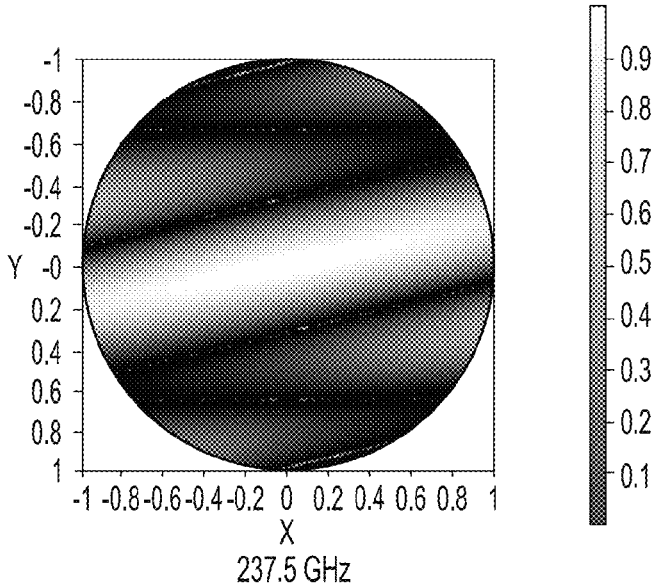

FIG. 6B shows the analytical far-field pattern of the array at the beginning, center, and end of the band.

Figure 7A:
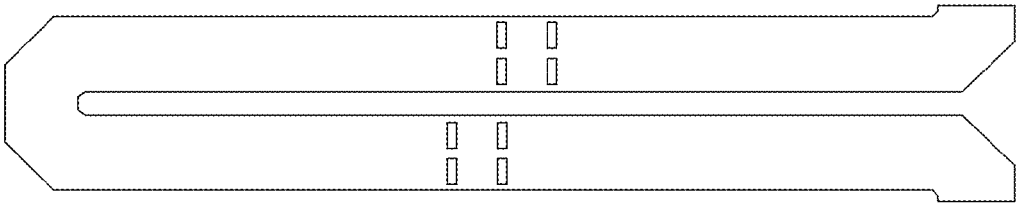

FIG. 7A shows the final proposed structure with smaller spacing between the elements.

Figure 7B:
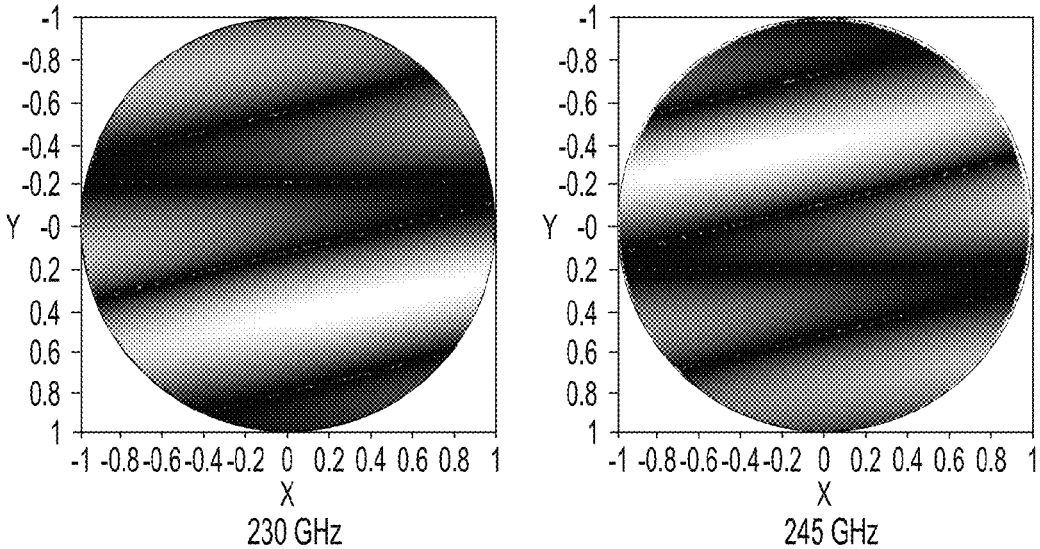
Figure 7B:
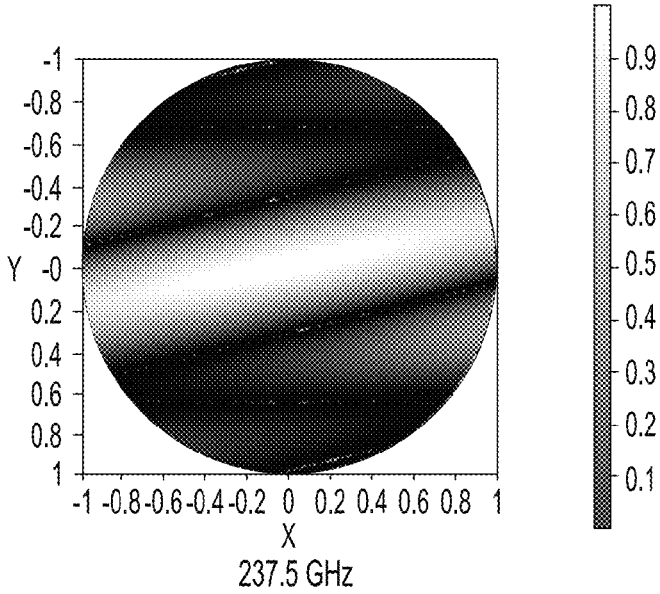

FIG. 7B shows the analytical far-field pattern of the array at the beginning, center and end of the band. It is observable that the grating lobe is removed.

Figure 8A:
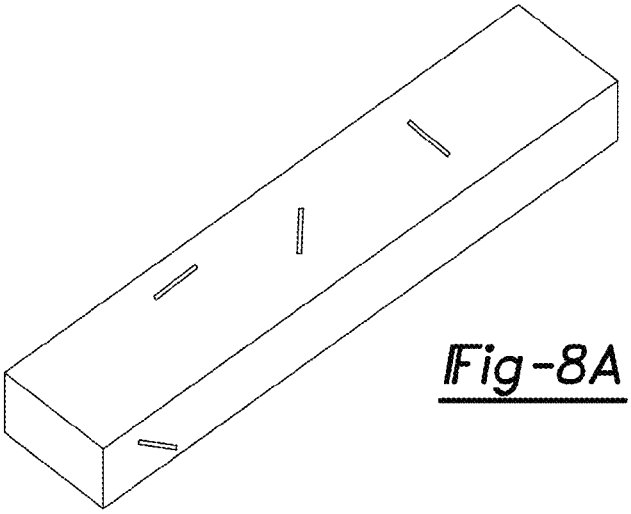

FIG. 8A shows the different configuration of slots cut on the walls of a rectangular waveguide.

Figure 8B:
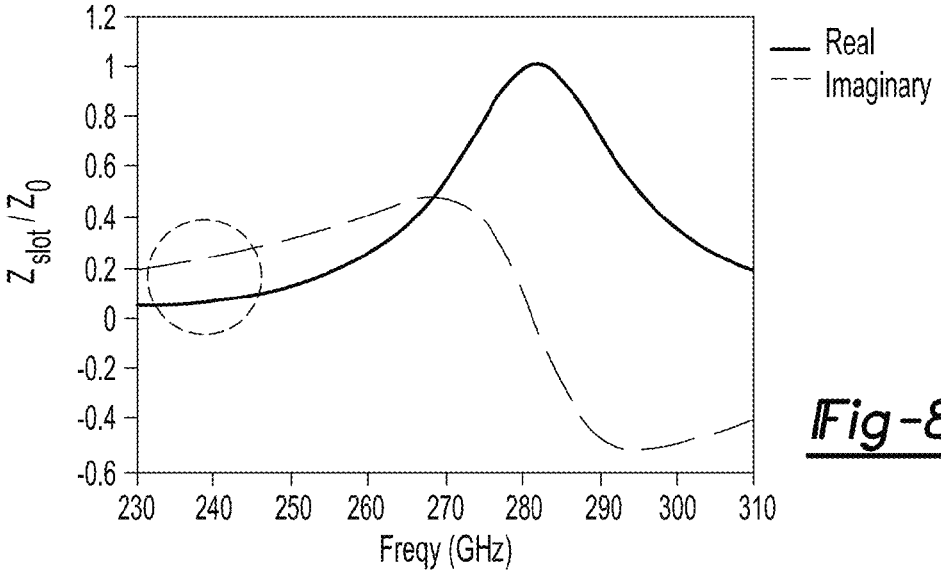

FIG. 8B shows the normalized slot impedance versus frequency. A resonance happened at 282 GHz.

Figure 8C:
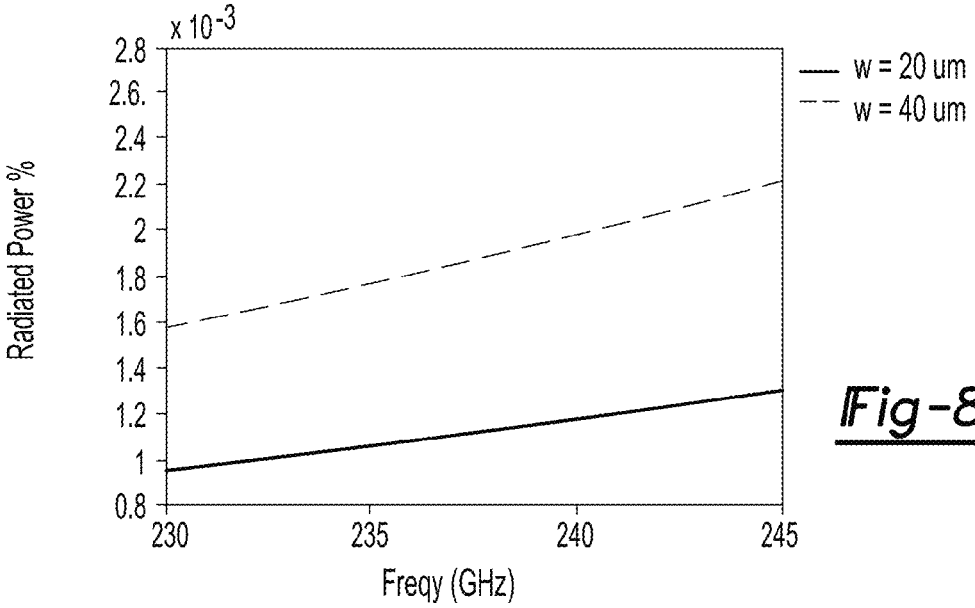

FIG. 8C shows the total power associated with a non-resonant slot for two different widths.

Figure 9:
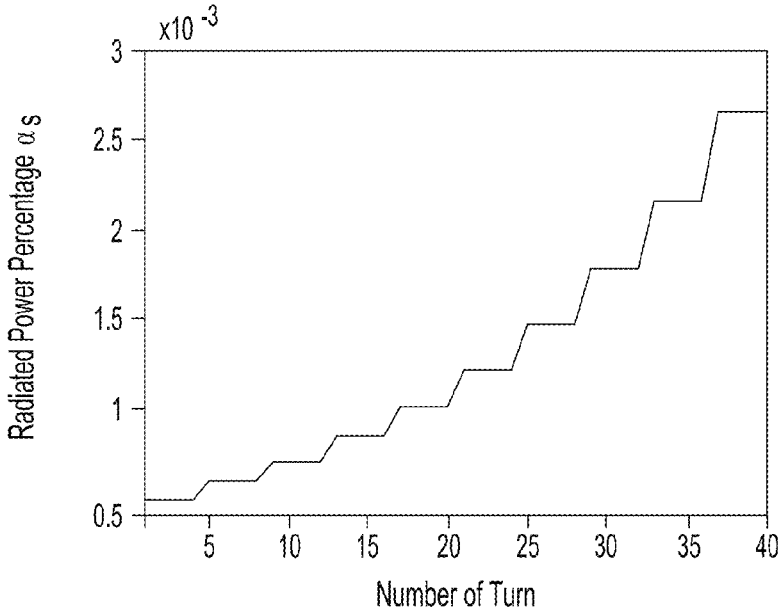

FIG. 9 is a table that shows the percentage of the radiated power in each turn. The slots dimensions for each unit cell remain constant.

Figure 10A:
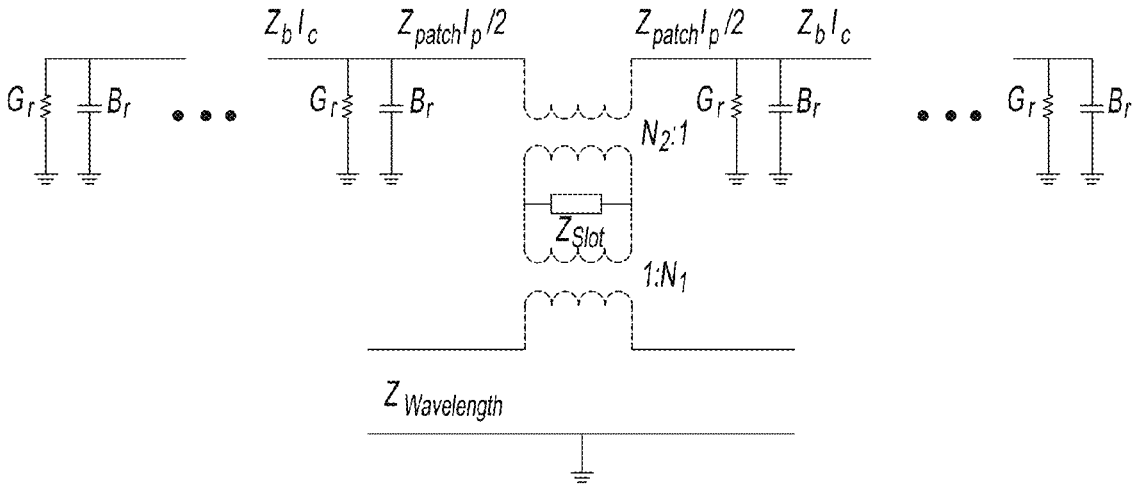

FIG. 10A shows an equivalent circuit model of the hybrid-coupled patch array.

Figure 10B:
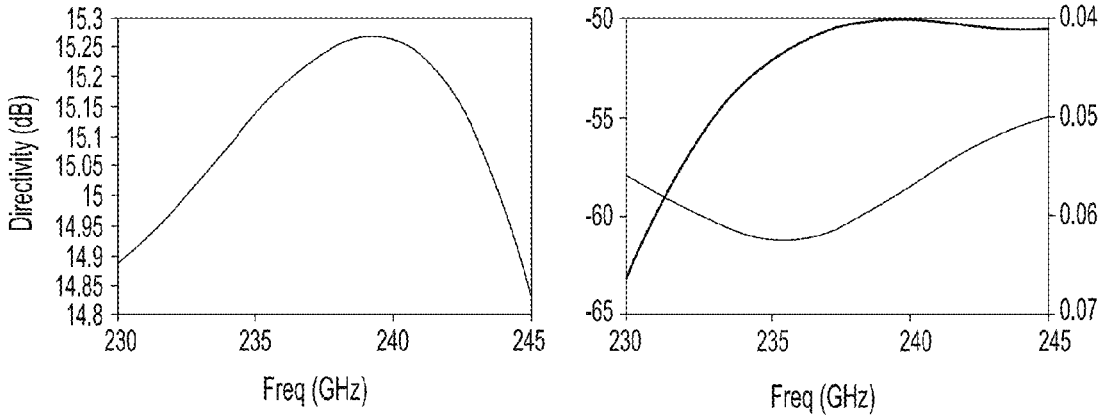

FIG. 10B shows directivity of the hybrid-coupled patch array and the S-parameters of the waveguide for the center patch length of 390 um. The lengths of the center patch and connecting line to the series-fed array are optimized in such a way that the directivity is maximized and the S-parameters show resonance.

Figure 10C:
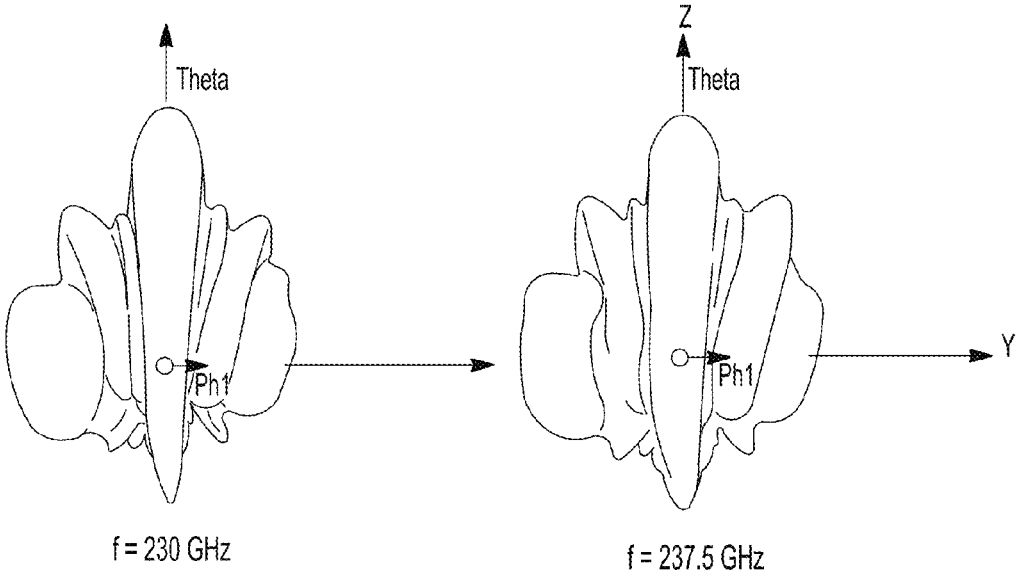

FIG. 10C shows far-field radiation pattern of the antenna.

Figure 11A:
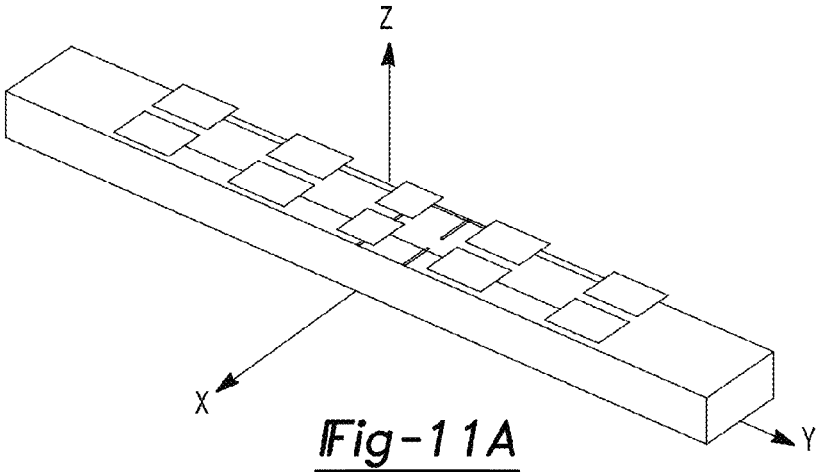

FIG. 11A shows a hybrid-coupled patch array fed by the main slot.

Figure 11B:
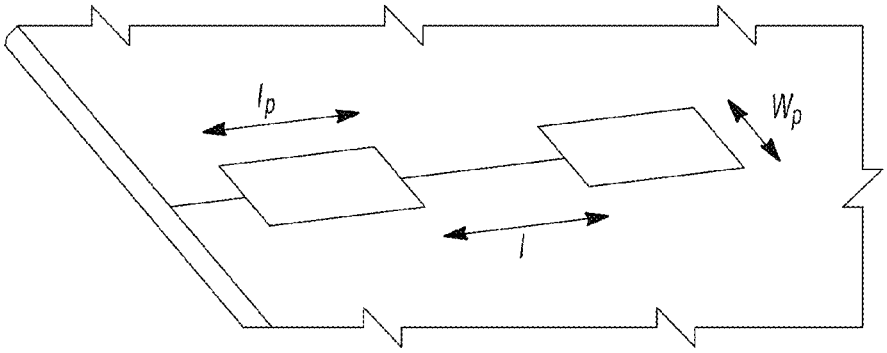

FIG. 11B shows a series-fed patch array.

Figure 11C:
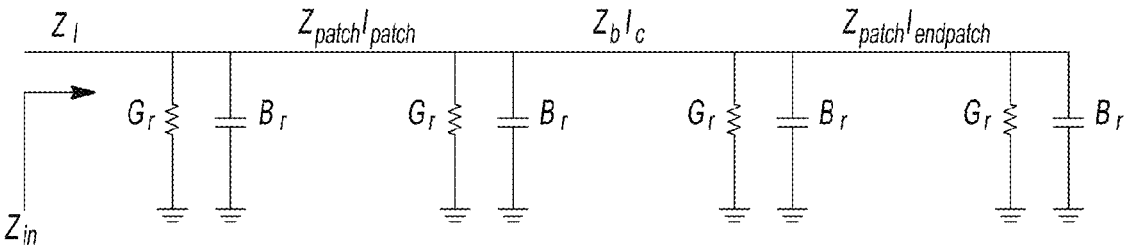

FIG. 11C shows an equivalent circuit model of the series-fed patch array.

Figure 12A:
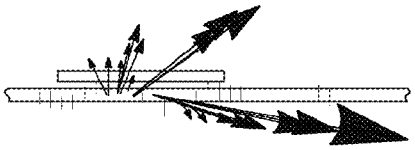

FIG. 12A shows a field distribution for air substrate at 230 GHz with an 80 um substrate.

Figure 12B:
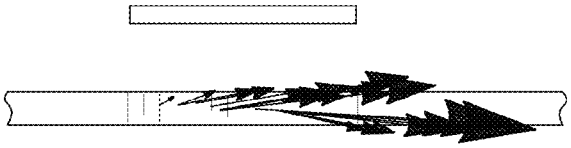

FIG. 12B shows a field distribution for air substrate at 230 GHz with a 250 um substrate with silicon walls.

Figure 13A:
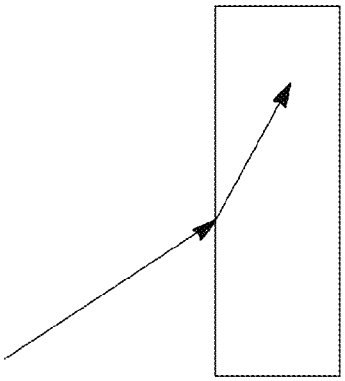

FIG. 13A shows the electric field at the boundary of two dielectric materials.

Figure 13B:
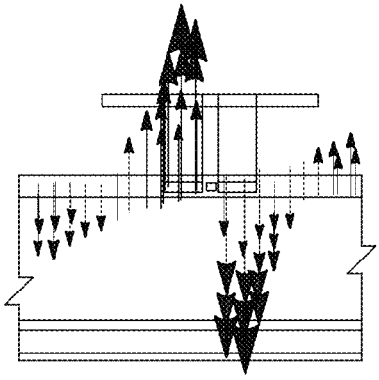

FIG. 13B shows the high dielectric vertical walls.

Figure 13C:
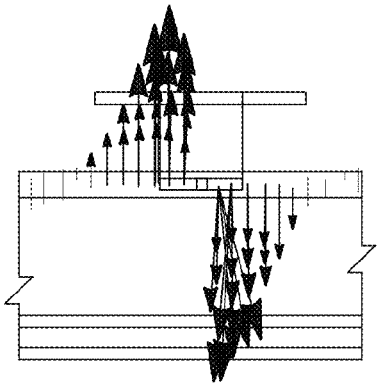

FIG. 13C show the dielectric block.

Figure 14A:
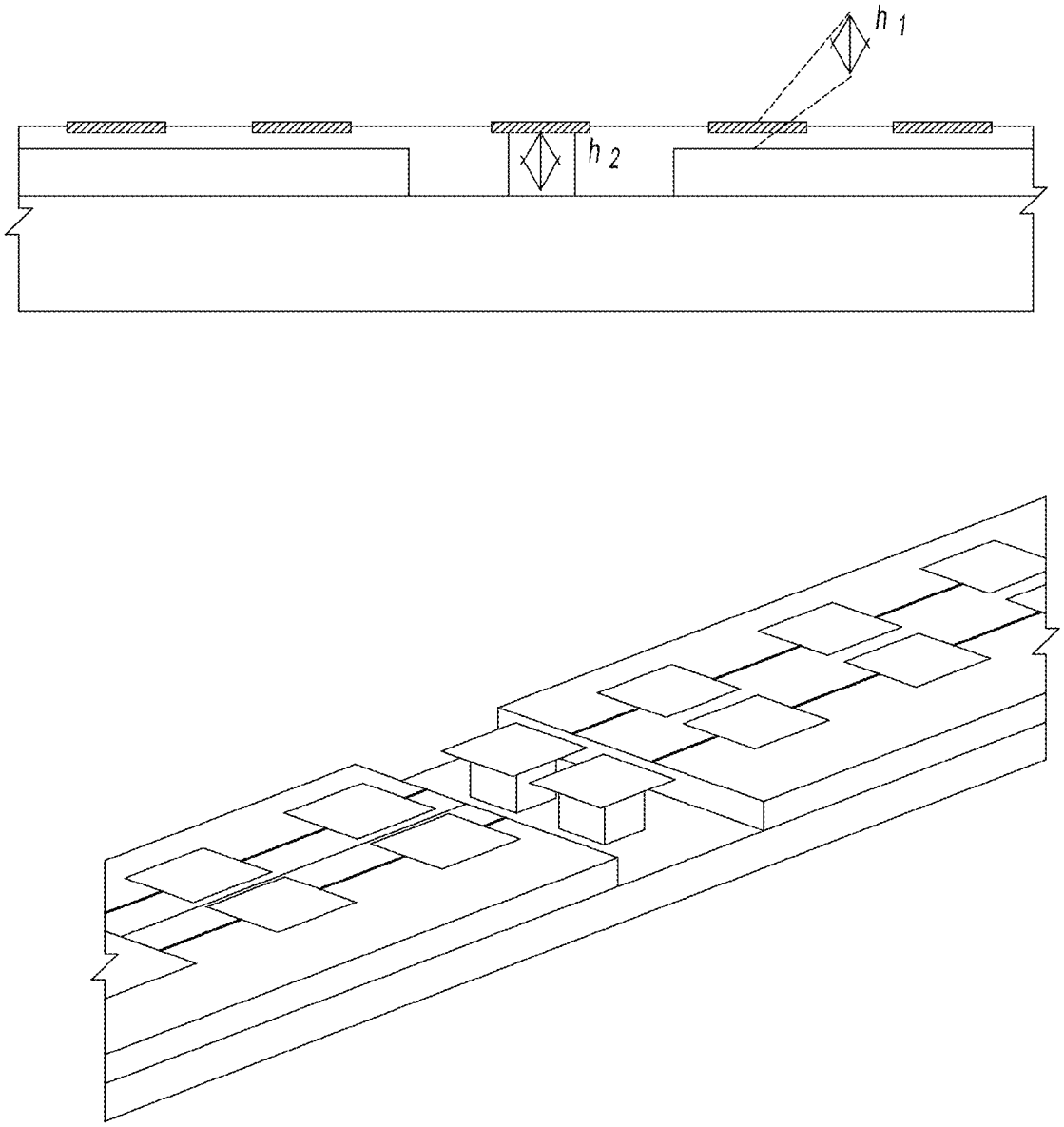

FIG. 14A shows the proposed hybrid-coupled patch array with silicon block.

FIG. 14B shows the electric field distribution.

FIG. 14C shows the radiation pattern at the center frequency 237.5 GHz.

FIG. 14D shows the directivity over the frequency band.

Figure 15:
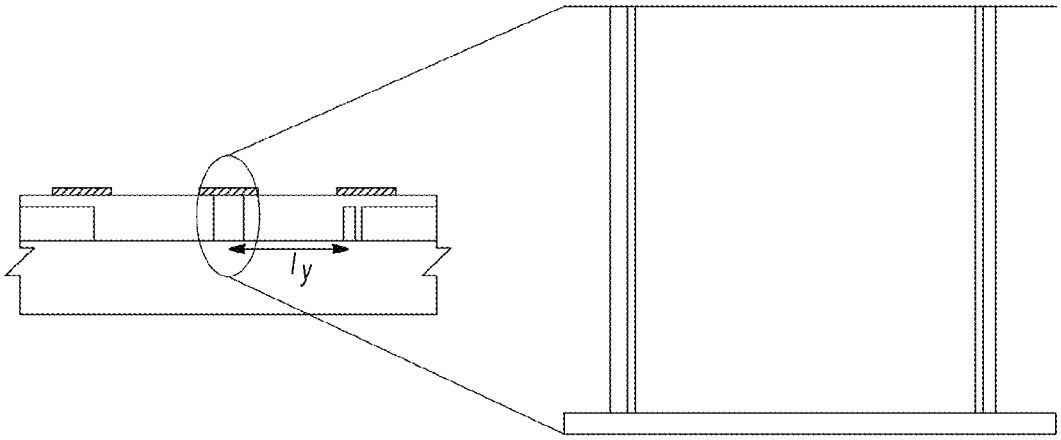

FIG. 15 shows a developed version of a hybrid-coupled patch array compatible with microfabrication.

Figure 16A:
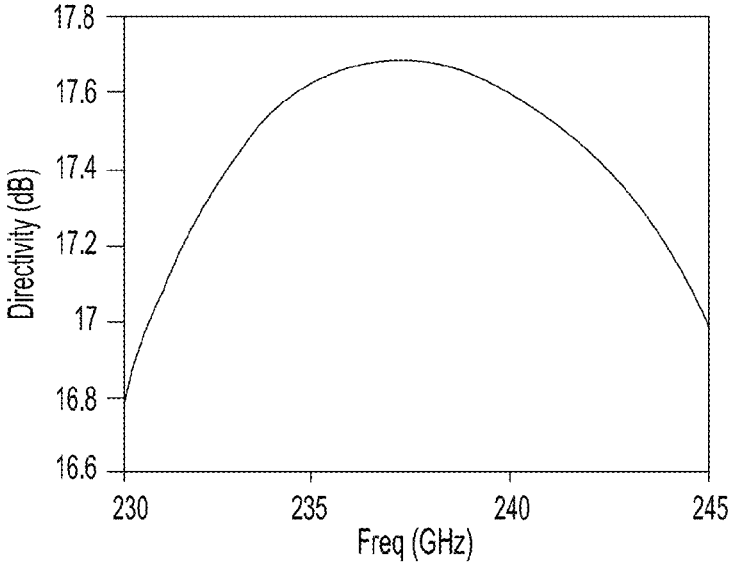
Figure 16B:
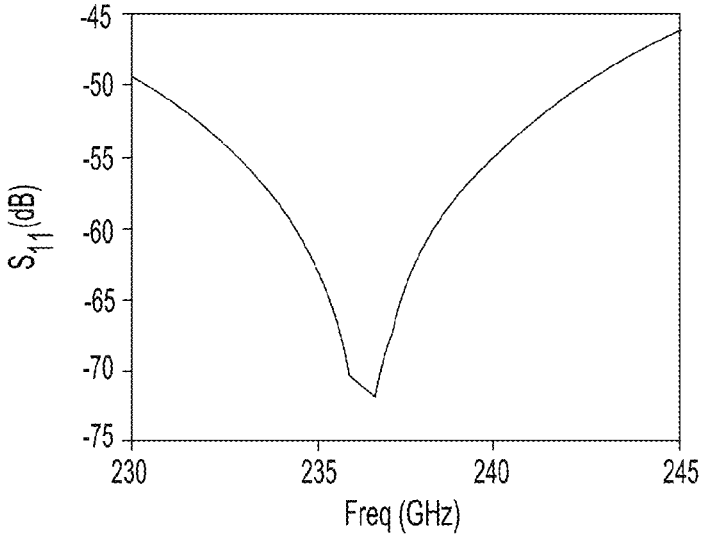

FIGS. 16A-B show the Directivity and Return Loss frequency for the proposed hybrid-coupled patch array.

Figure 17A:
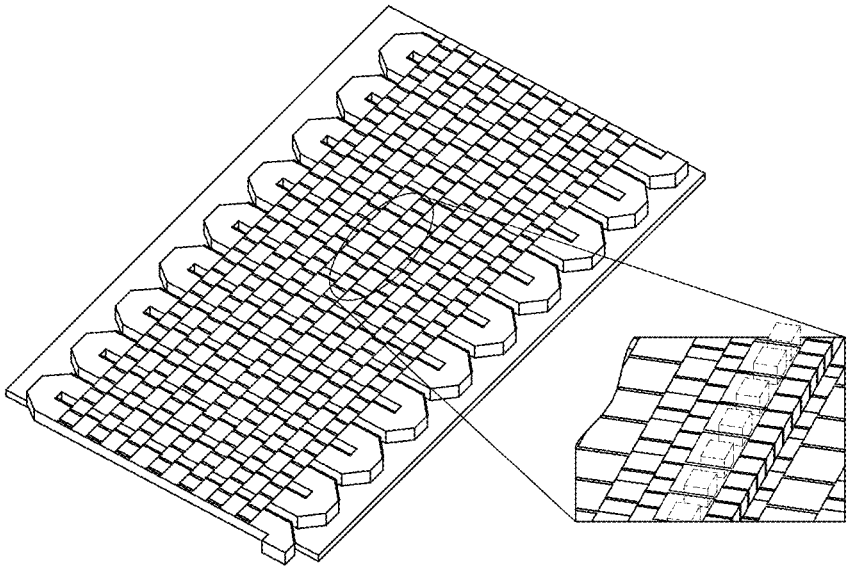

FIG. 17A shows the final antenna structure.

Figure 17B:
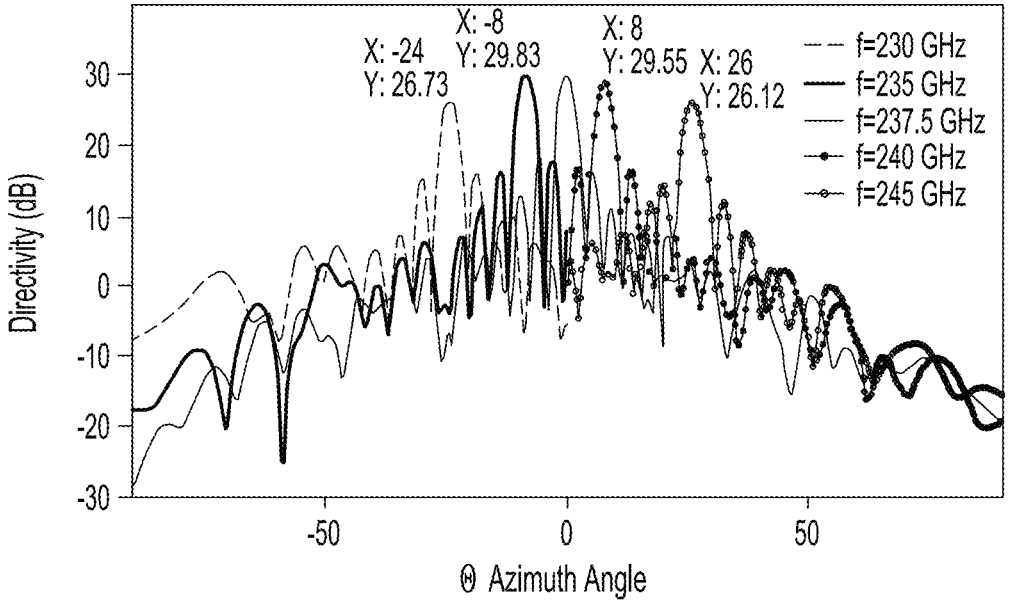

FIG. 17B shows the radiation pattern.

Figure 18A:
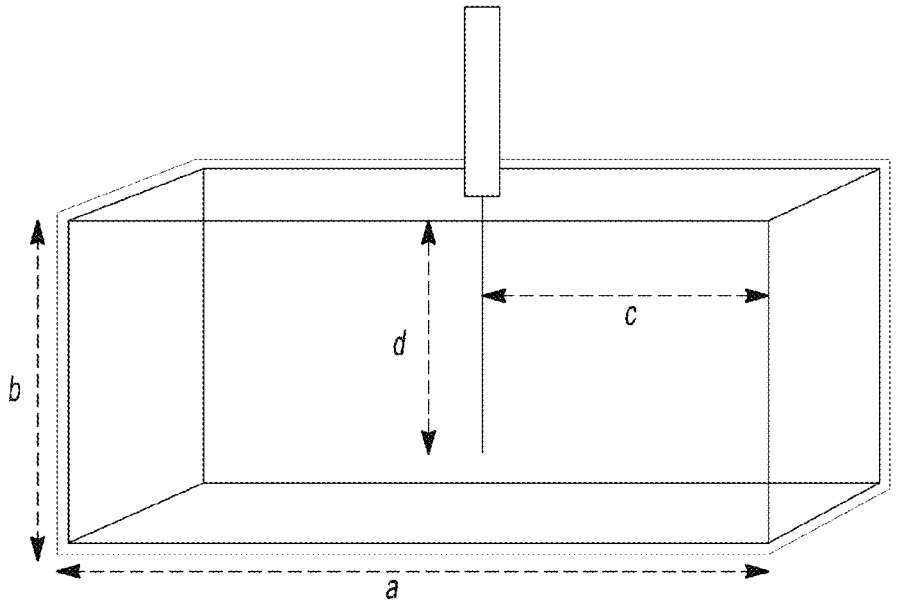

FIG. 18A shows the suspended E-plane probe excitation.

Figure 18B:
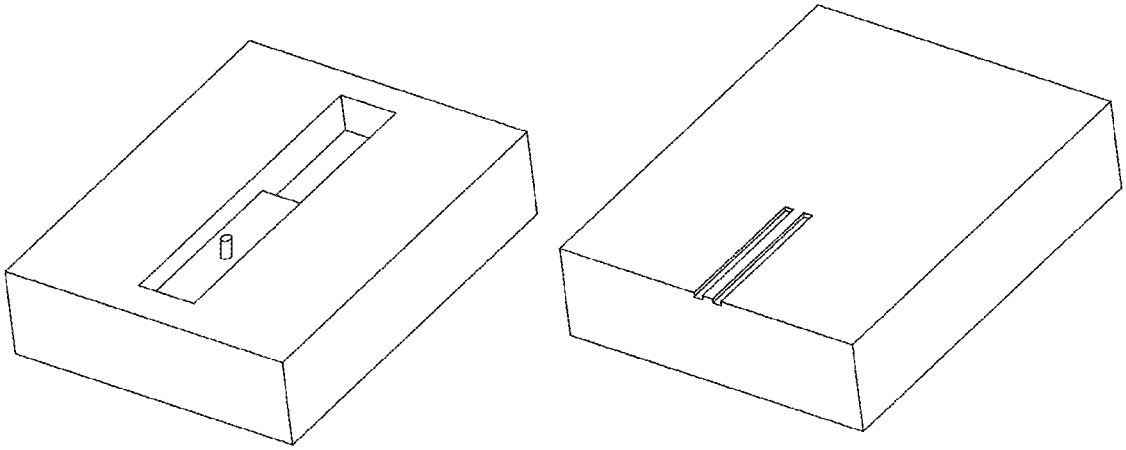

FIG. 18B shows the waveguide trench and the probe are patterned and etched on one substrate while the CPW line is patterned on another substrate. The two wafers are eventually bonded together to form the transition.

Figure 19:
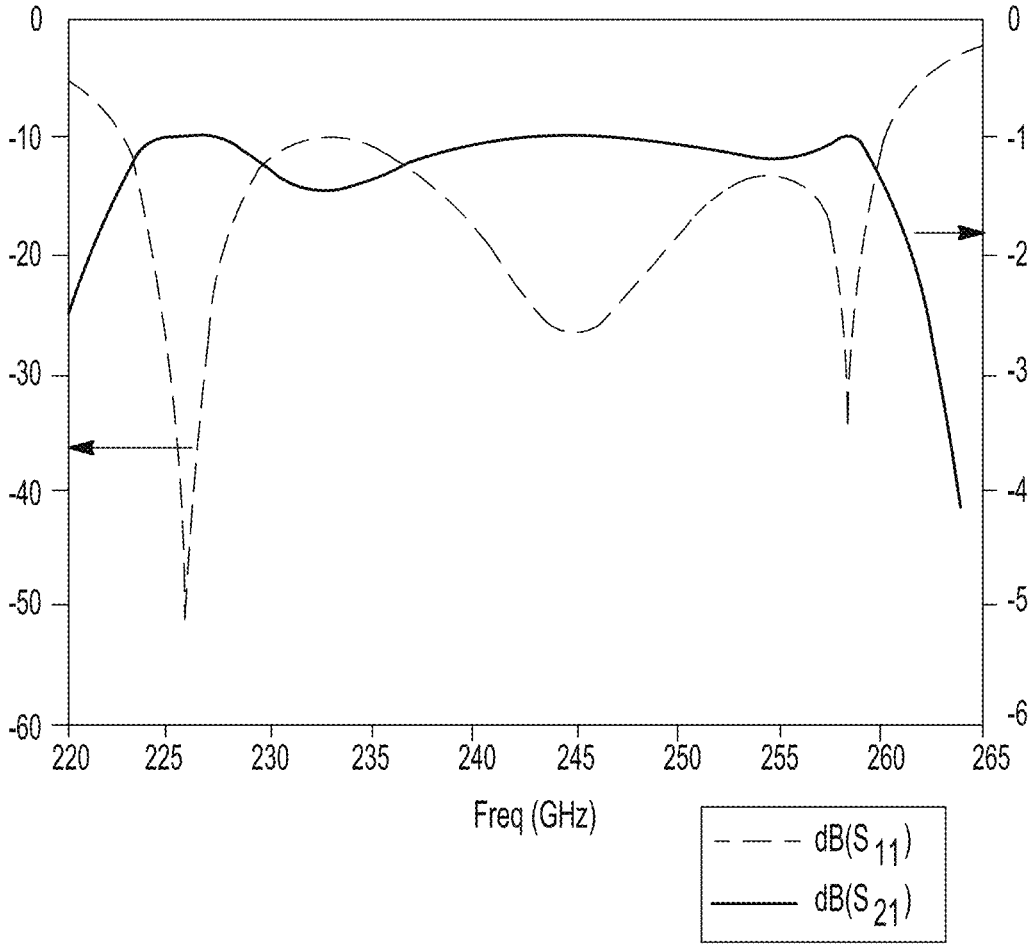

FIG. 19 is a table showing a transition from a novel low-loss membrane supported CBCPW to rectangular waveguide.

Figure 20A:
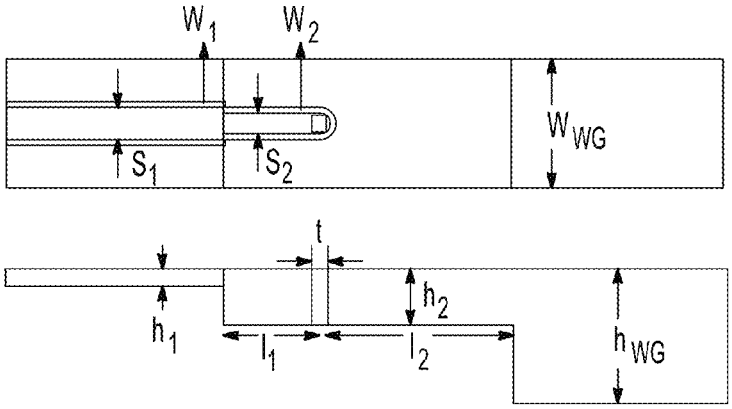

FIG. 20A shows a CBCPW to rectangular waveguide transition, top view, side view, and the perspective of a back-to-back configuration, which includes a transition from CBCPW to CPW, CPW to reduced-height waveguide and reduced-height waveguide to the standard WR-3 rectangular waveguide.

Figure 20A:
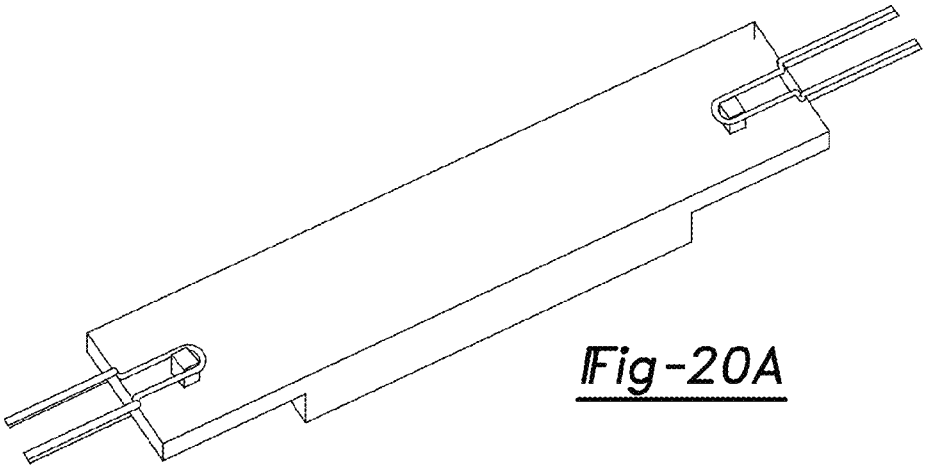
Figure 20B:
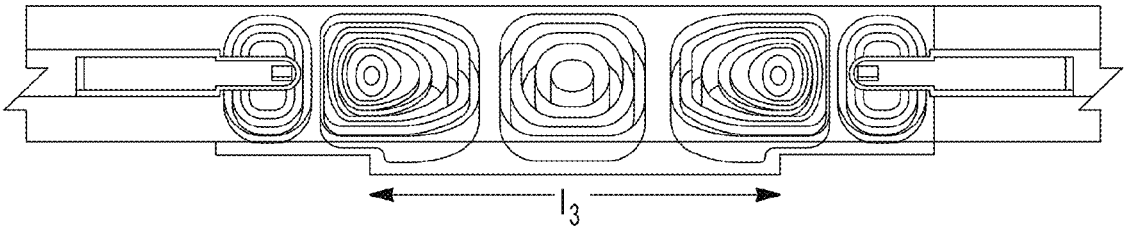

FIG. 20B shows a simulated electric field distribution inside the structure.

Figure 21:
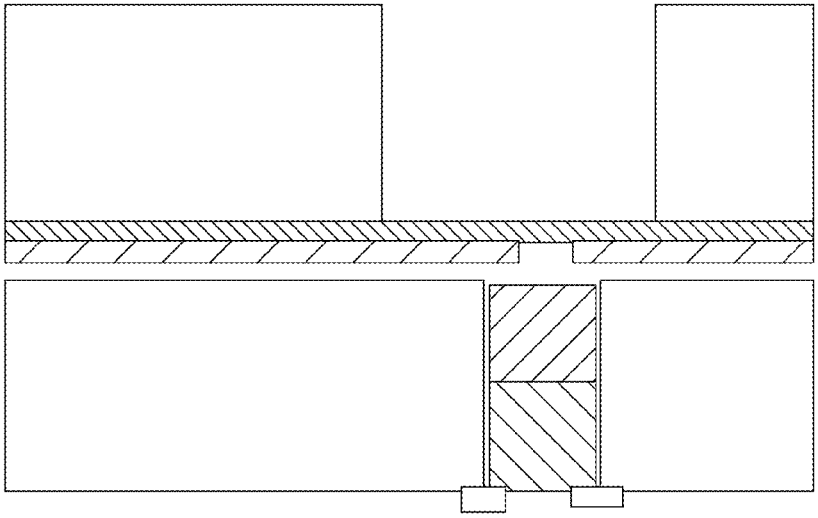

FIG. 21 is a schematic of the thru-wafer transition for active component integration.

Figure 22A:
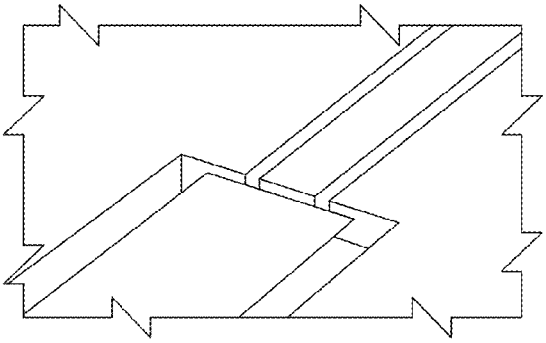

FIG. 22A shows the schematic of the transition from grooved CPW to the CBCPW.

Figure 22B:
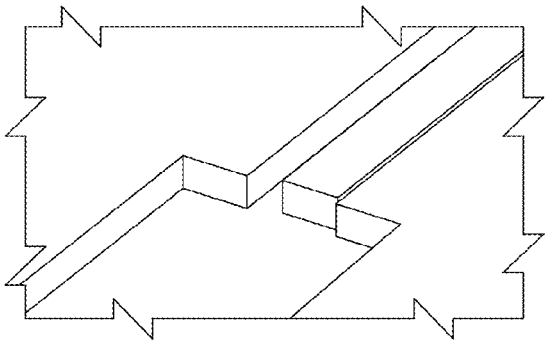

FIG. 22B shows the bottom substrate with the top layer removed.

Figure 23A:
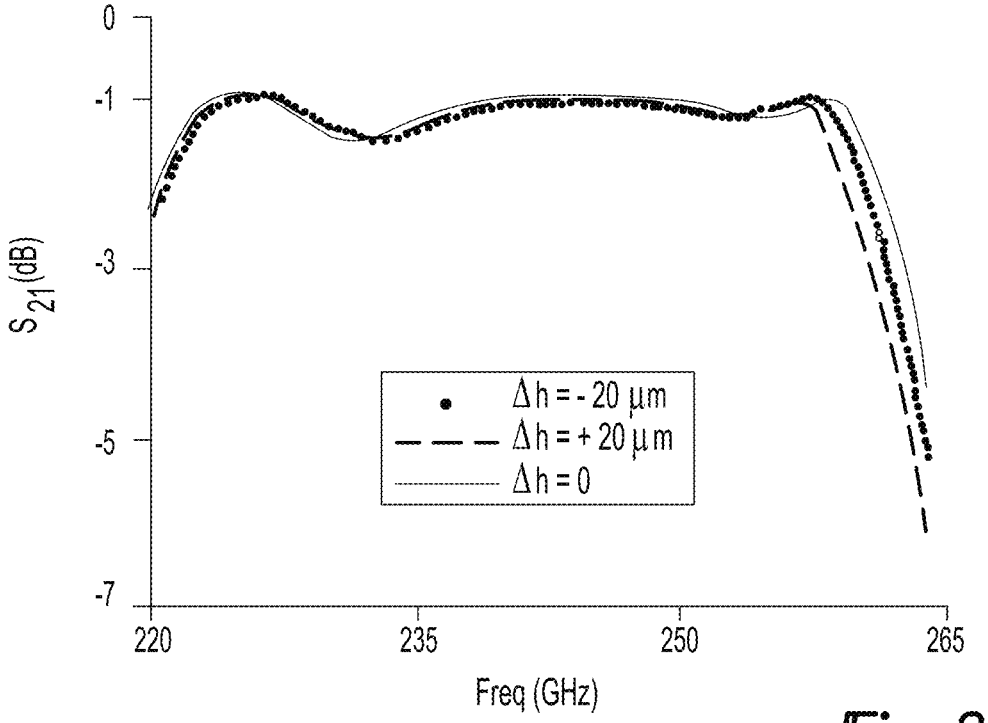

FIG. 23A shows the transmission coefficient of the transition when $h_{WG}$ is varied ±20 μm (~5%) showing the response of the transition is insensitive to variations in waveguide height.

Figure 23B:
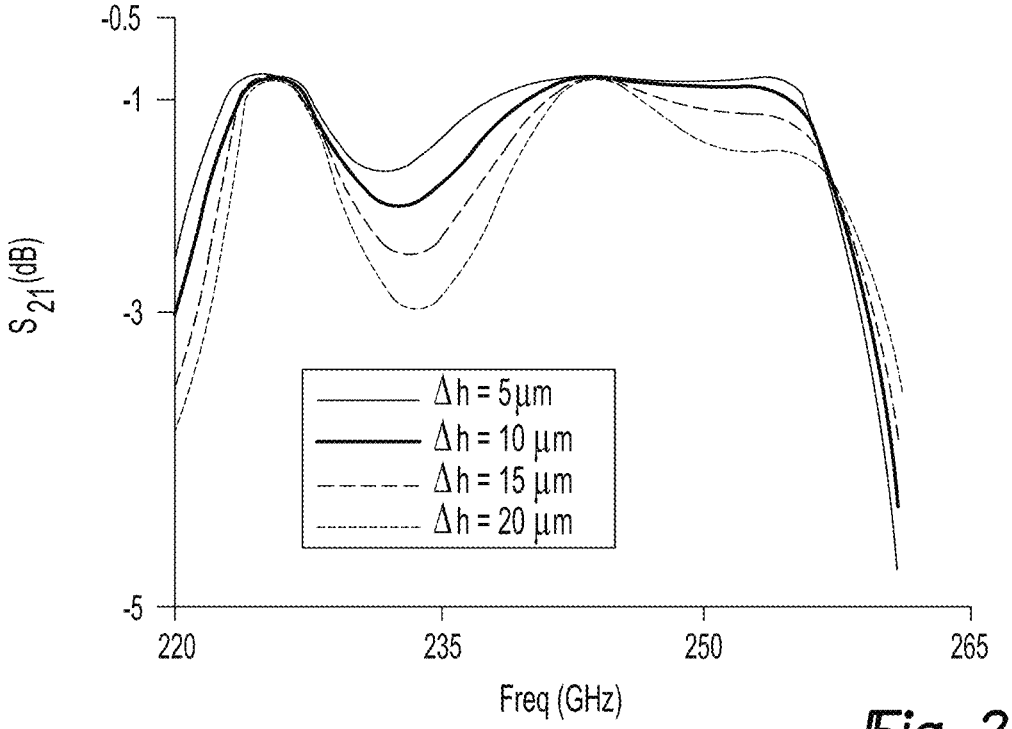

FIG. 23B shows the transmission coefficient of the transition when the response is shown to be more sensitive to the reduced waveguide height $h_2$ for Δh>5 μm.

Figure 23C:
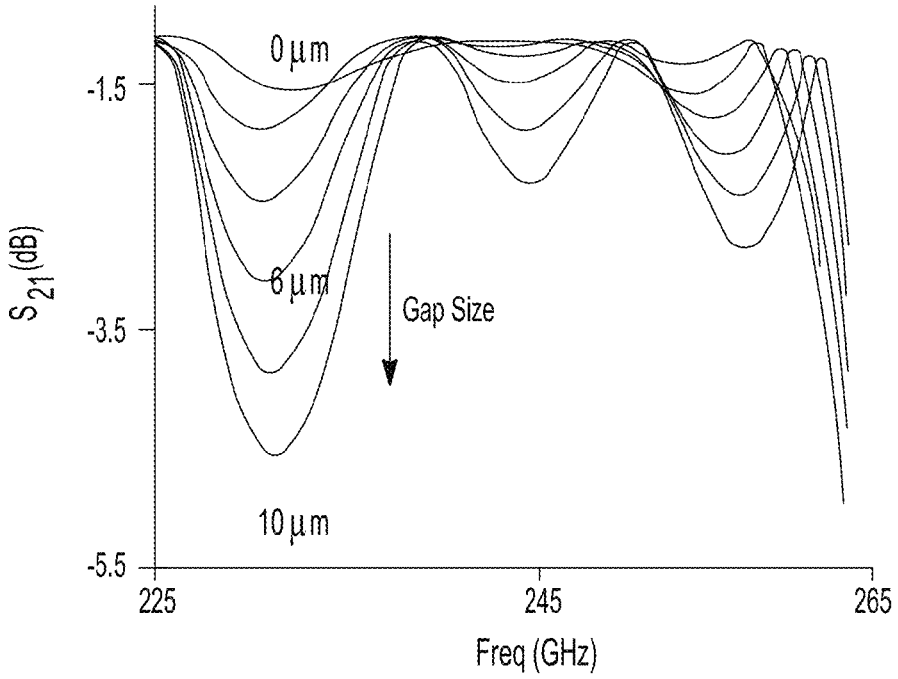

FIG. 23C shows the transmission.

Figure 23D:
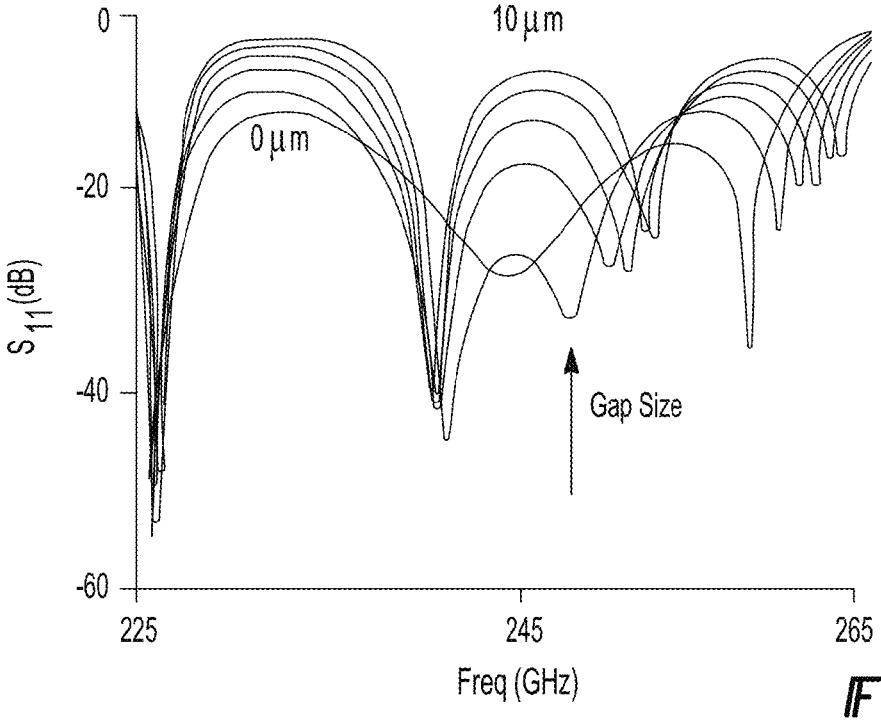

FIG. 23D shows the reflection coefficient when a gap is modeled between the top of the pin on the bottom wafer and the top wafer.

Figure 24:
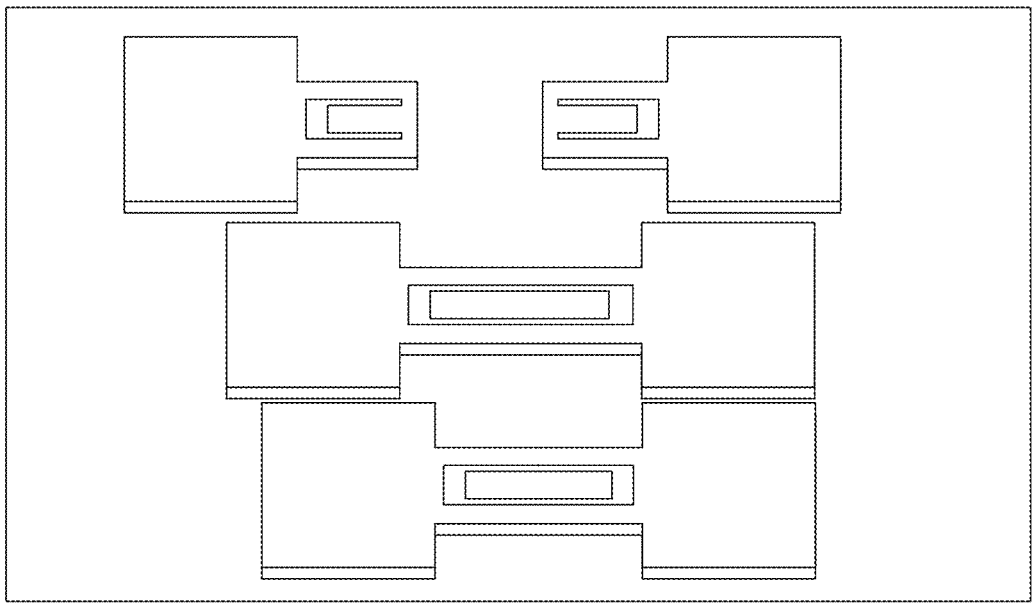

FIG. 24 shows TRL calibration lines fabricated on the same wafer.

Figure 25:
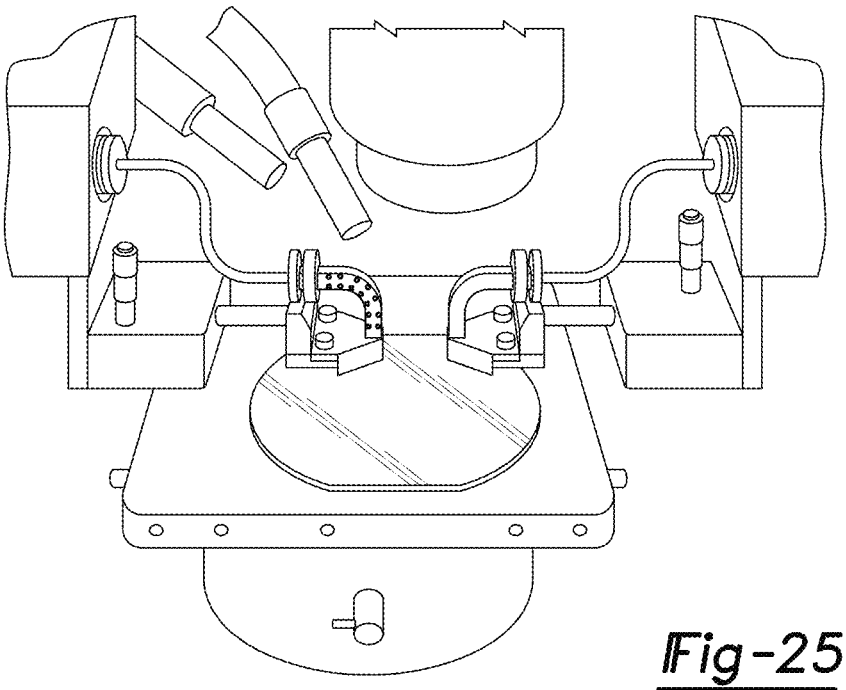

FIG. 25 shows a dual source PNA-X with OML frequency extenders connected to GSG probes to excite the CPW.

Figure 26A:
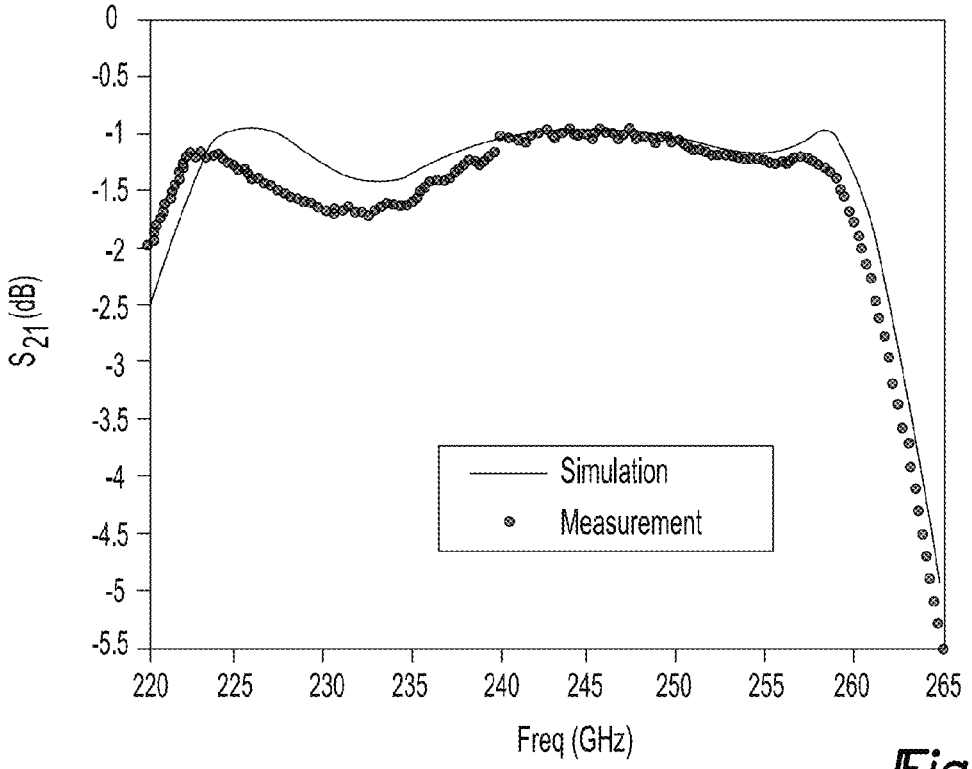
Figure 26B:
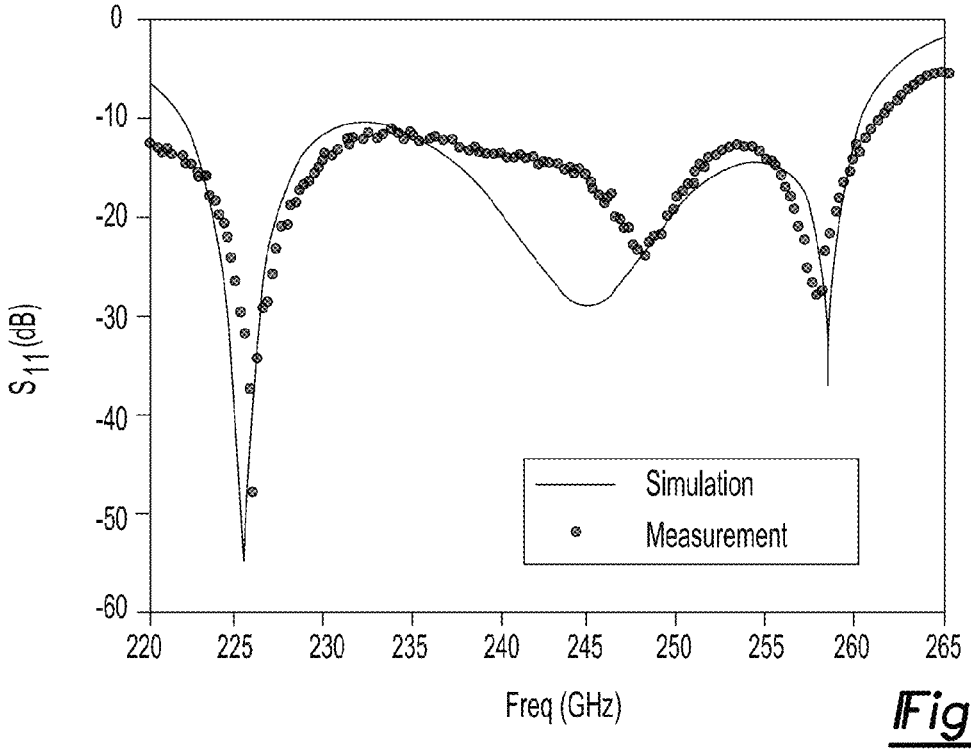
Figure 27A:
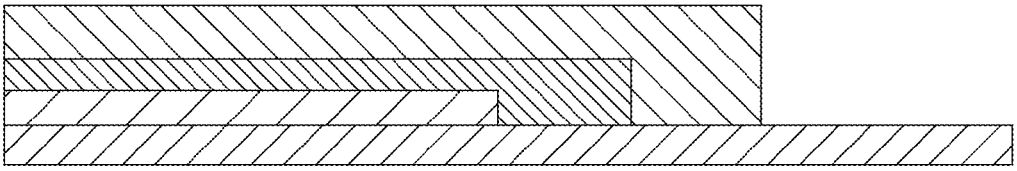
Figure 27B:
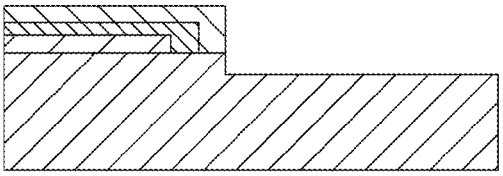
Figure 27C:
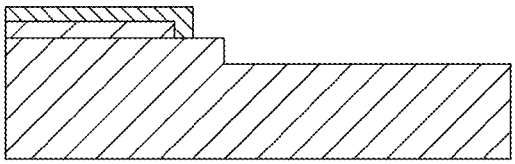
Figure 27D:
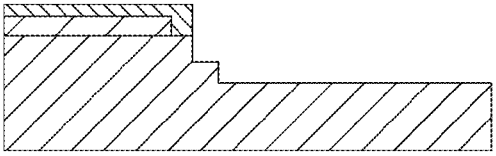
Figure 27E:
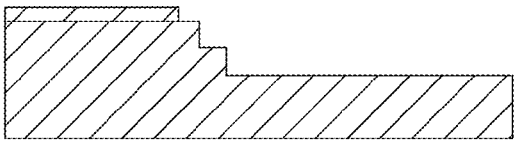
Figure 27F:
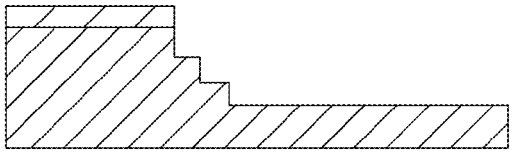
Figure 27G:
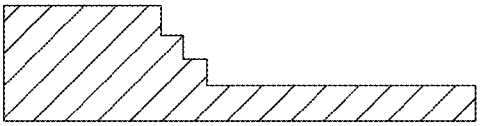

FIGS. 26A-B shows measured transmission and reflection coefficients of the back-to-back transition structure.

FIGS. 27A-G shows the multi-step etching process for the bottom wafer.

Figure 28A:
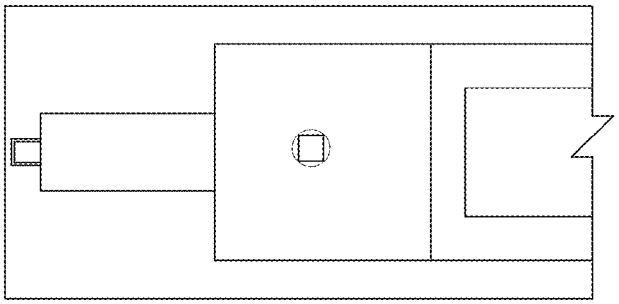
Figure 28B:
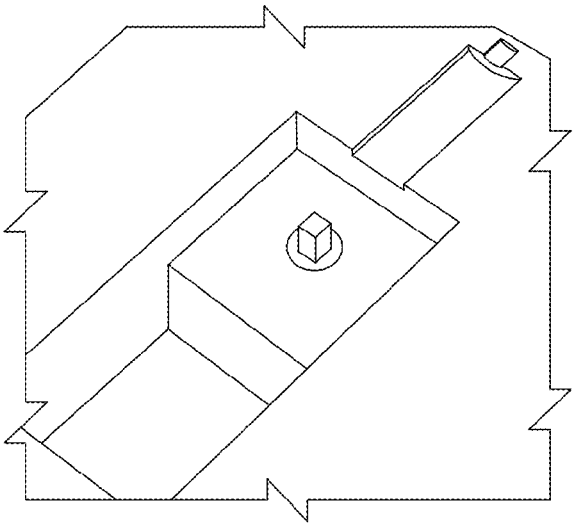

FIG. 28 shows the microscopic images of the three-step etching: (A) before etching, (B) after etching, (C) back-to-back structure.

FIG. 29 shows the grooved CPW: (A) before, (B) after removing the shadow walls, (C) SEM photo of the backwall (tilted 20 degrees) which verifies that the shadow walls prevented gold deposition effectively.

Figure 30A:
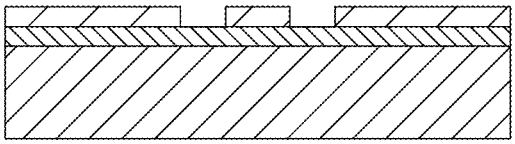
Figure 30B:
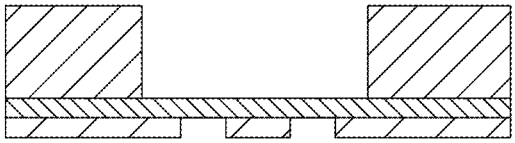
Figure 30C:
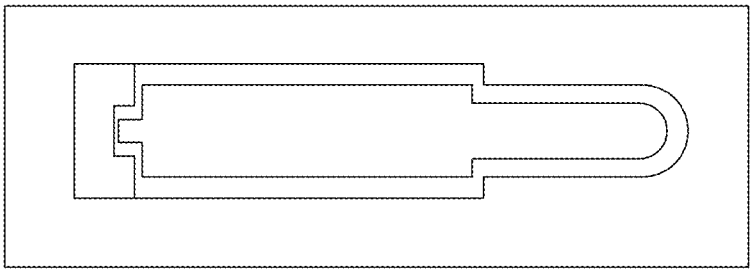

FIGS. 30A-C shows the top wafer fabrication process.

Figure 31A:
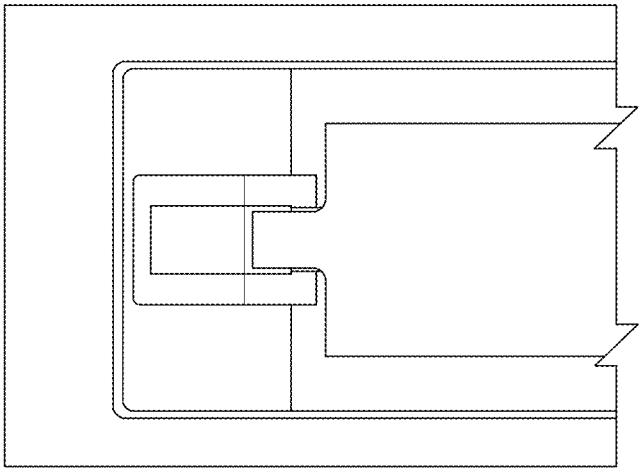
Figure 31B:
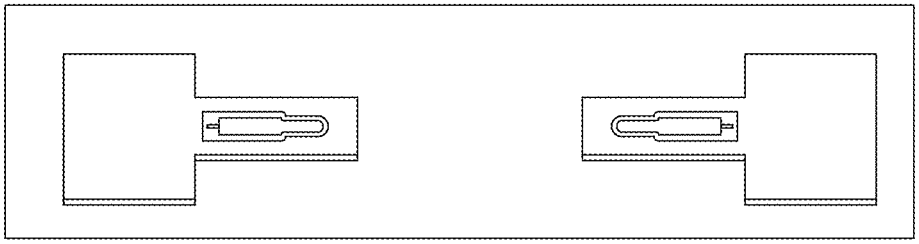

FIGS. 31A-B shows the final fabricated transition.

Figure 32A:
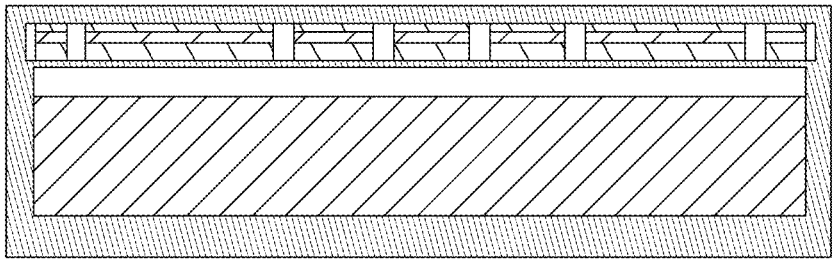

FIG. 32A shows the third wafer with path array pattern, Parylene membrane and the photoresist release layer.

Figure 32B:
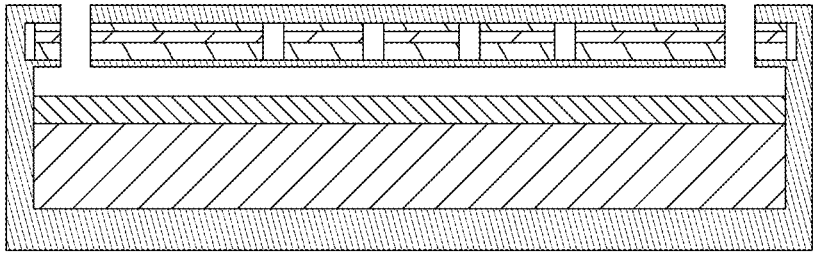

FIG. 32B shows the photoresist removed with acetone and isopropyl alcohol.

Figure 33:
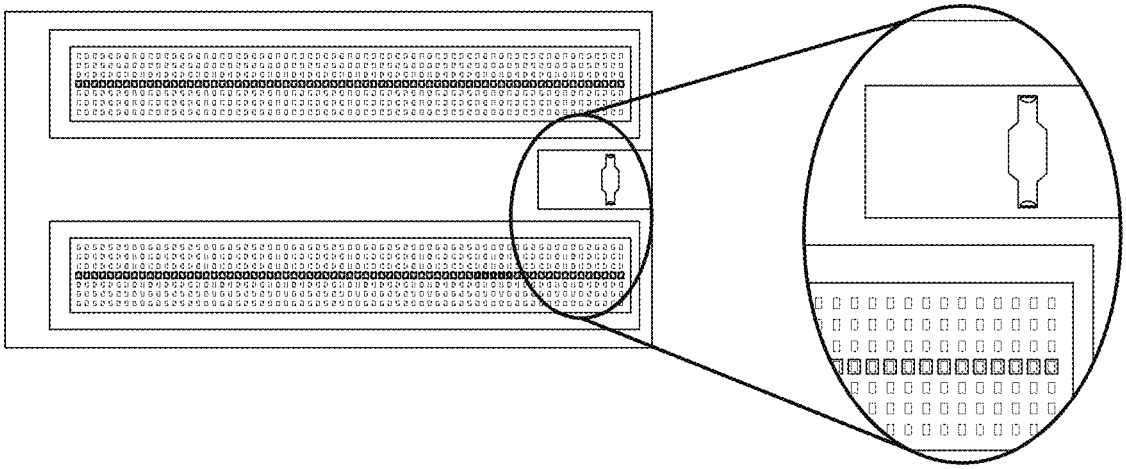

FIG. 33 shows the final fabricated antenna structure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

I. Design Considerations

Figure 1A:
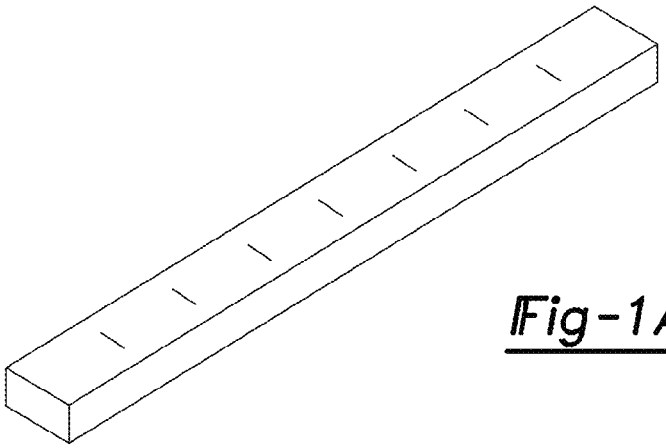
FIG. 1B is a waveguide-based helical slot antenna.
FIG. 1C is a planer meander-line waveguide slot antenna.
FIG. 1D is a unit cell of the proposed structure.
Figure 1B:
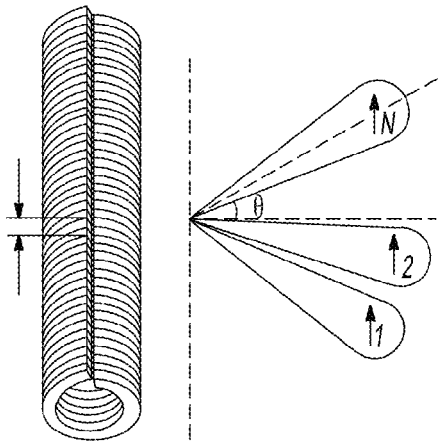
Figure 1C:
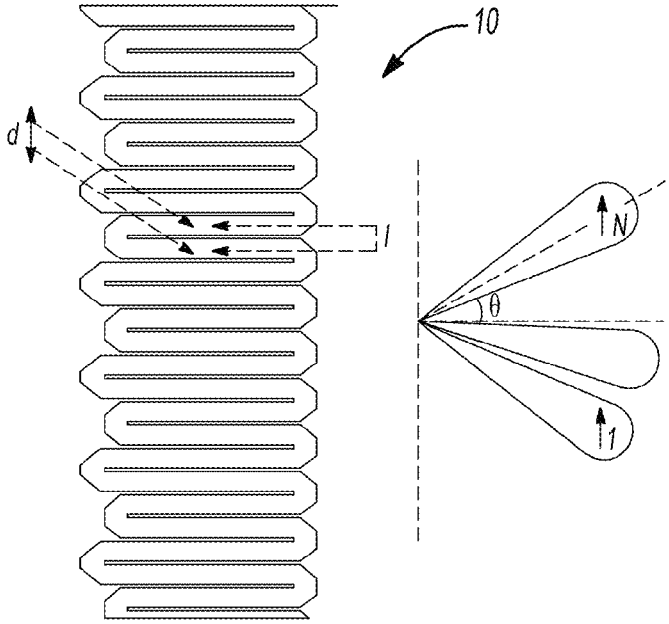
Figure 1D:
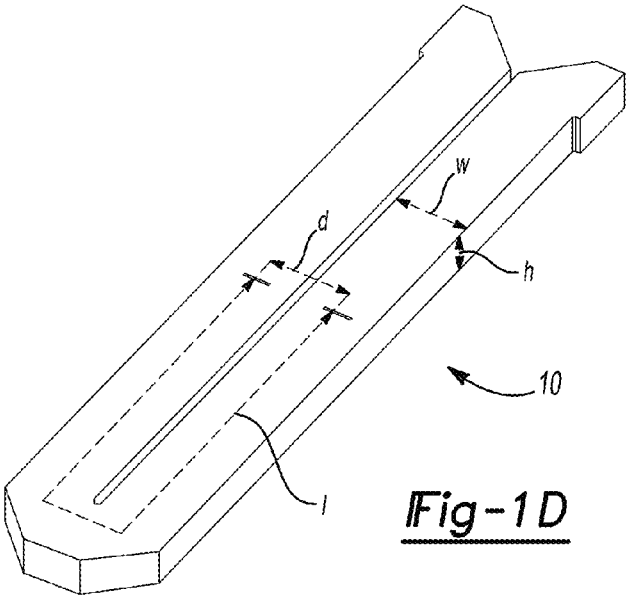

The initial structure is shown in FIG. 1A in which slots are cut along the broad wall of the waveguide. The frequency scanning antenna is designed for comparatively large scanning angles (±25°) around the broadside angle. Since the propagation constant along the rectangular waveguide is smaller than that of the free space ($\beta<\beta_0$), with spacing smaller than half a wavelength in free space (to avoid generating grating lobes), phase shift is always smaller than 2π and it is not possible to achieve broadside radiation. To resolve this problem, slots can be positioned with spacing larger than half a wavelength and the grating lobes can be suppressed using spatial filters. Another alternative is to have longitudinal or diagonal slots and take advantage of the "phase reversal" phenomenon considering the current distribution. However, these methods are not suitable for frequency scanning applications because with a limited bandwidth, none of them can provide a sufficient amount of phase shift between slots along the waveguide to generate large scanning angles. According to array factor formula $$AF=\sin(N\psi/2)/\sin(\psi/2) \quad (1)$$

where, $\psi=kd\sin(\theta)+\phi$, k is the wavenumber, d is the spacing between array elements, $\phi$ is the phase shift between elements which is equal to $\phi=\beta d$ and $\beta$ is the propagation constant of the $TE_{10}$ mode in the waveguide. The maximum available scanning angle independent of the spacing between slots is calculated as $$\theta_1 = \sin^{-1}\left(\lambda_1\left(\frac{1}{\lambda_{g0}} - \frac{1}{\lambda_{g1}}\right)\right) \tag{2}$$

where, $\lambda_{g0}$ and $\lambda_{g1}$ are guiding wavelengths at the center and maximum frequencies. At Y-band, considering the dimensions of the WR-3 standard waveguide (a=864 μm, and b=432 μm), we need to provide approximately 130 GHz bandwidth around 230 GHz to achieve ±25° scanning angle around an off-broadside angle, which is not practical. In order to achieve broadside radiation and a satisfactory amount of phase shift between elements without the need for a large bandwidth, we are required to meander the waveguide so that the distance between slots is increased which results in the increase in phase shift, while maintaining the spacing between them at a smaller quantity in order to avoid generating grating lobes. The original proposed structure is represented in FIG. 1B. The spacing between radiating elements is around the width of the waveguide while the circumference of one turn of the helix is the delay segment between the elements. This helical waveguide is bulky, heavy and difficult for fabrication at MMW frequencies. Therefore, the planar meander-line waveguide 10 is proposed in FIG. 1C. In this design, the waveguide 10 is bent around the H-plane to have the radiating elements cut on the broad wall of the waveguide so that microfabrication techniques are able to manage etching the height of the waveguide, which is more durable than etching the thick width of the waveguide. In this structure, $\psi=kd\sin(\theta)+\beta l$ where d is the spacing between elements which is the sum of the waveguide width and the separating wall, while l is the length between them in each turn as shown in the unit cell of the structure in FIG. 1D. Hence, while it is feasible to realize broadside radiation at any desired frequency with $\beta l=2n\pi$ since l is flexible; the maximum scanning angle can also be calculated as $$\theta_1 = \sin^{-1}\left(\frac{l\lambda_1}{d}\left(\frac{1}{\lambda_{g0}} - \frac{1}{\lambda_{g1}}\right)\right) \tag{3}$$

To have the broadside radiation at the center frequency, l is chosen to be a modulus of $\lambda_{g0}$ in order to generate $2n\pi$ phase shift between the elements at the center frequency. Table 1 shows the range of scanning angle assuming 15 GHz available bandwidth (230~245 GHz) around the broadside radiation at 237.5 GHz for different values of wall thicknesses and length between elements.

TABLE 1

The scanning angle of the antenna for different wall thicknesses and lengths between elements.

| Thickness of the separating wall d = a + t | Length between the elements | Range of the scanning angle |
|---|---|---|
| t = 50 μm | I = 4 $\lambda_{g0}$ | 23.3°~-21° |
| t = 150 μm | I = 5 $\lambda_{g0}$ | 26.4°~-23.7° |
| t = 250 μm | I = 5 $\lambda_{g0}$ | 24°~-21.8° |
| t = 50 μm | I = 4.5 $\lambda_{g0}$ | 26.4°~-23.7° |
| t = 250 μm | I = 5.5 $\lambda_{g0}$ | 26.5°~-23.8° |

The structure of the meanderline waveguide 10 requires the current distribution on the broad wall of the waveguide reverses after a turn as shown in FIG. 2. Therefore, the length between slots must be corrected by adding a $\lambda_{g0}/2$ segment so that the magnetic current on the slots are in phase at the center frequency. The additional segment increases the scanning angle as shown in Table I.

To achieve a very narrow beamwidth (i.e. $\alpha=2°$), the length of the antenna must be extended by using a number of these unit cells. The length is calculated from $$\alpha = \frac{\lambda}{L} \Rightarrow L = \frac{\lambda}{\alpha} \tag{4}$$

where, L is the aperture length. At 230 GHz, L=37.4 mm to achieve 2° beam width, which give around 36 turns for t=1114 μm.

Since the overall waveguide length is quite large (~36l=36 cm), and a large number of slots are involved, sources of loss and reflection from the finite conductivity of metals, waveguide turns, and slots must be managed very carefully.

A. Reflection

There are two sources of reflection in the meander-line structure: from the bends and from the slots. To minimize the reflection from the bends, the profile of the bends should be designed for a minimum reflection. This can be performed by optimizing the shape of the bends using Ansoft HFSS. Simulations results show that a diagonal cut around the edges provides a better transmission compared to a curved turn as shown in FIG. 3A and FIG. 3B. However, even though the reflection from bends is minimized, a number of successive small reflections from all bends make a considerable amount. One way to minimize total reflection from bends is to make the distance between bends an odd modulus of $\lambda_g/4$ at the center frequency to make a destructive interference—the two ways distance should be a modulus of $\lambda_g/2$—so that the total reflection is cancelled. A unit cell of such a structure is presented in FIG. 5A consisting of four waveguide sections. In this structure, in order to have the slots in phase while having $\lambda_g/4$ spacing between the elements, the length of one of cells should be $\lambda_g$ smaller. FIG. 5B shows the reflection coefficient of this structure. It is observed that although the reflection is minimized at the center frequency, it is a considerable amount in other frequencies and might cause a constructive interference and large reflection in the final structure consisting nine unit cells. FIG. 5C represents the reflection coefficient for the total of nine unit cells which shows a very high return loss around 233 and 243 GHz. Another way to minimize the total reflection is to have constructive interference for the center frequency, since the reflection of the bend is already minimized by optimizing the diagonal cut shown in FIG. 3. In this case, the reflection in the beginning and the end of the band is minimized by changing the thickness of separating walls to make the destructive interference. The reflection coefficient of the structure is shown in FIG. 4B and FIG. 4C for one and nine unit cells. The maximum reflection is below −18 dB as opposed to −2 dB reflection for the former structure, while the reflection at the center frequency is maintained around −60 dB. This structure has thicker separating walls which makes it stiffer and suitable for microfabrication.

To minimize the reflection of the slots, having cut one slot in each turn, the two-way distance between two successive slots is an integer multiple of $\lambda_g$ ($2\times5.5=11\lambda_g$ in this design). Therefore, their successive reflections add up coherently and causes scan blindness at the center frequency. To mitigate this problem we need a reflection canceling pair for each slot positioned at $\lambda_g/4$.

Two Unit Cells

A unit cell of the proposed geometry is shown in FIG. 6A. In this case, the array factor can be written as:

$$AF = 1 + e^{-jk_0 d_y \sin(\theta)\sin(\varphi)+j\phi_1} + e^{jk_0 d_x \sin(\theta)\cos(\varphi)+j\phi_0} + e^{jk_0(d_x \sin(\theta)\cos(\varphi)+d_y \sin(\theta)\sin(\varphi))+j(\phi_0+\phi_1)} \quad (5)$$

where $\phi_0=\beta_g l$ and $\phi_0=\beta_g d_y$, $d_y=\lambda_g/4$, $l=5.5\lambda_g$ For the actual values of $d_x$=a+250 μm=1114 μm the array factor of the whole array is represented in FIG. 6B. It is observable that the grating lobes are generated due to the fact that the spacing is larger than half a free space wavelength ($\lambda_0$=1.2 mm) which is imposed by the width of WR-3 waveguide. To overcome this problem, we cut two slots along the width of the waveguide to make the spacing half as shown in FIG. 7A. The array factor of this structure can now be written as:

$$AF = 1 + e^{jk_0 d_x \sin(\theta)\cos(\varphi)} + e^{-jk_0 d_y \sin(\theta)\sin(\varphi)+j\phi_1} + e^{jk_0(d_x \sin(\theta)\cos(\varphi)-d_y \sin(\theta)\sin(\varphi))+j\phi_1} + e^{jk_0(2d_x \sin(\theta)\cos(\varphi)+d_y \sin(\theta)\sin(\varphi))+j(\phi_0+\phi_1)} + e^{jk_0(3d_x \sin(\theta)\cos(\varphi)+d_y \sin(\theta)\sin(\varphi))+j(\phi_0+\phi_1)} \quad (6)$$

The pattern is represented in FIG. 7B. As it is shown, the grating lobes in the azimuth direction have been removed.

B. Conductor Loss

In a rectangular waveguide, the conductor loss is calculated from $$\alpha = \frac{R_m(2bk_c^2 + ak_0^2)}{ab\beta_{TE_{10}} K_0 Z_0} \quad (7)$$

where $$R_m = \sqrt{\frac{\omega\mu_0}{2\sigma}},$$

σ is the electrical conductivity, $k_c$ the cut-off frequency of the waveguide, $k_0$ wavenumber, $Z_0$ free space characteristic impedance, a and b are width and height of the waveguide. In 230~245 GHz band, α≈18 dB/m for gold and 16 dB/m for copper and the total loss for the meander-line structure is around 6.6 dB for gold and 5.9 dB for copper which mean around 20% of the power reaches the end of the waveguide. The amount of radiated power from slots should be managed accordingly in order to have a uniform power distribution for each element.

C. Slot Positioning and Shape

FIG. 8A represents different configurations of slots; transverse, diagonal and longitudinal on the narrow and broad walls of the waveguide. Due to the configuration of the meander-line structure, slots on the narrow wall of the waveguide cannot be used. Longitudinal and diagonal slots on the broad wall of the waveguide are widely employed in waveguide arrays. With these slots, because of the phase reversal technique, it is possible to achieve broadside radiation and avoid grating lobes with slots positioned at half a guiding wavelength. Transverse slots are not commonly used in array applications for broadside radiation mainly because the spacing is twice as much the longitudinal slots which results in grating lobes. However they are successfully used in traveling-wave arrays for off-broadside radiation and are suitable for the application of this work since the spacing is already smaller than half a wavelength and the length required to generate the desired phase shift is provided by the length of the meander-line structure. In addition, the main role of the slots is to feed the patch array and since the patch should provide narrow beam in the elevation direction, it should be positioned along the waveguide. For the array positioned along the waveguide, transverse slots are the only options for excitation.

At the resonant frequency, the amount of radiated power and thus the radiation resistance of a slot is maximized as shown in FIG. 8B that represents a resonant frequency around 282 GHz. However, since in a large array it is mostly desirable to distribute the power evenly among the elements, small amount of power is apportioned to each slot and thus the slots should be non-resonant. Therefore, the dimensions of the slots are chosen to be much smaller than $\lambda_0/2$ to make them non-resonant. This causes non-zero reactive part for radiation power. This is compensated later by using patches on top of the slots which make them resonant, although the length is not $\lambda_0/2$. By changing the dimensions of the slots, we can control the amount of radiated power off of each slot. FIG. 8C shows the total power associated with a non-resonant slot (radiated plus stored) for slots with around $\lambda_0/4$ length at two different widths. Since the amount of propagating energy is decreased along the waveguide as it is partly radiated and stored around each slot, and lost due to the finite conductivity of metal, the dimensions of the slots should be increased gradually so that the radiated power remains constant throughout the length of the waveguide even though the input power is decreased. To design the slot dimensions, first we assume that the radiated power from the four adjacent slots in each turn is constant. Therefore, considering the conductive loss, in each turn $$P_2=P_1-4\alpha_s P_1-\alpha_c P_1 \quad (8)$$

where, $P_1$ and $P_2$ are the input and output powers in the waveguide, $\alpha_c$ is the percentage of the conductive loss and $\alpha_s$ the percentage of the radiated power off of each slot. For the next turn, the amount of the input power is decreased to $P_2$ hence $\alpha_s$ for each slot should be increased so that the total power $\alpha_s P$ remains constant. Again the input power in the third turn decreases and the dimension of the slots should be increased. FIG. 9 shows the planned $\alpha_s$ for each turn. According to this design, we start from slots with 300 μm×5 μm dimensions for the first turn and end with those with 300 μm×60 μm for the last one.

D. Hybrid-Coupled Patch Array

The one-dimensional array of slots generates a very wide beam in the elevation direction. For many applications ranging from collision avoidance to indoor mapping, this wide beamwidth is not desirable due to the possibility of the interference caused by other targets. In order to confine the beam, we need to provide a long aperture in that direction as well. This can be performed by designing patch arrays which are fed by these slots.

FIG. 11A shows a hybrid-coupled patch array proposed to provide a narrow beam in the elevation direction. In these arrays, the patches are positioned on top of the slots separated by a dielectric substrate. The center patch is fed by the slot on the bottom layer of the substrate, while the other patches are series-fed through the center one. The feeding is a combination of both planar and non-planar feeding methods. The main advantage of this coupling method is the ability to control the illumination function separately in both array directions in order to produce a specified radiation pattern so that while the pattern is scanning in the azimuth direction, it is fixed in the elevation direction.

However, there are some problems associated with patch antennas at high frequencies, such as very thin substrates are required in order to suppress the propagation of the surface waves. For example, at 230 GHz, 50 μm glass or 20 μm silicon substrates are only around one tenth of the guiding wavelength and it is almost impossible to handle these very thin substrates. Yet at the same time, they are thicker than what can be spun or deposited specifically for most commonly used low-loss materials (such as spin-on glass which can be spun up to 5 μm). Hence, using a dielectric substrate for the patch array is not desired. Instead, air substrate can be used and the patch array is suspended on a thin layer of dielectric material. With air substrate, no surface waves are excited, bandwidth is improved and the efficiency is highly enhanced.

In general, the design procedure can be organized in two parts: the series-fed patch array and the aperture-coupled patch. The series-fed array consists of patches and high impedance transmission lines. Quarter-wave transmission-line sections can also be used to minimize the return loss. To design a broadside standing wave patch array, all the patches must be in phase so that both the patches and the connecting lines are approximated to be half a guiding wavelength long. To obtain nearly uniform illumination for all the patches, the widths are chosen identical. For maximum radiation, the patch width is approximated as $$W = \frac{\lambda_0}{2}\sqrt{\frac{2}{\varepsilon_r + 1}} \tag{9}$$

At 230 GHz for air substrate W=652 μm. The width of the waveguide plus 'the thickness of the separating walls (t=a+250 μm=1114 μm) should be able to accommodate the width of two patch arrays (given that there are two slots along the width). Since W>1114 μm/2, we are required to decrease the width. This will also increase the gap and help decrease the mutual coupling between the adjacent arrays. One the other hand, wider patch provides narrower beamwidth in the azimuth direction which helps lower the side lobe level. Therefore, an optimized width is required to provide a narrow enough beamwidth in the azimuth direction with a minimized mutual coupling at the same time.

Assuming W=390 μm, a three-element series-fed patch array with the help of the equivalent circuit model of the patch antenna is designed and shown in FIG. 11B and FIG. 11C. The equivalent conductance and susceptance of the patch antenna for $h/\lambda_0<0.1$ are calculated as $$G_r = \frac{W}{120\lambda_0}\left(1 - \frac{1}{24}(k_0 h)^2\right) \tag{10}$$

$$B_r = \frac{W}{120\lambda_0}(1 - 0.636\ln(k_0 h))$$

where h is the thickness of the substrate. This model is used to approximate the lengths of patches and transmission lines which are slightly shorter than half a wavelength due the presence of the slot admittance $G_r+jB_r$. The end patch is slightly shorter than the other patches in order to match the open-circuit end to the rest of the array. The final optimization of the dimension is carried out by the Ansoft HFSS to achieve the minimized return loss at the center frequency.

As for the aperture-coupled patch, since the slot length is considerably shorter than half a wavelength, it is made resonant by placing a patch above it. The length of the central patch and the connecting transmission lines to the series-fed patch array are estimated using the circuit model shown in FIG. 10A and then optimized by using the Ansoft HFSS in such a way that the S-parameters are resonant and the directivity of the antenna is maximized at the center frequency as shown in FIG. 10B. The pattern of the hybrid-coupled patch array for a total of seven elements is presented in FIG. 10C.

To provide efficient slot-patch coupling, the thickness of the air substrate should be kept below 100 μm. For thicker substrates, the coupling is weakened as shown in FIG. 12. As mentioned before, hollow structures are fabricated using silicon bulk micromachining. Since patches and slots are fabricated on either side of the substrate, custom-made, non-standard ultra-thin wafers have to be used with precise thickness as the substrate. These substrates are expensive and hard to handle. To make the structure more robust for fabrication, the feasibility of using thick standard substrate is investigated. As shown in FIG. 13 incorporating dielectric walls confine the field under the patch. The idea stems from the fact that the vertical field component of the slot adjacent to the dielectric wall with a higher dielectric constant is enhanced; since the tangential component of the electric field remains the same while the normal component is decreased by the ratio of dielectric constant of the two media. Therefore, the field is bent toward the boundary. Although a single patch may now be excited on thick substrate, the rest of the array can take advantage of a thin substrate by suggesting the structure shown in FIG. 14A, in which the center patch is fed through the slot with the thick air substrate and dielectric block, while the rest of the patches are series-fed with the original thin substrate. This structure can be fabricated on a thick standard wafer which is more robust. The optimized simulation results show low side-lobe level and acceptable directivity over the band shown in FIG. 14B and FIG. 14C.

The patch substrate should be metal coated as a part of fabrication process. However, as mentioned it is not possible to selectively deposit metal on multi-step substrates. The sidewalls of the silicon block and the reflection cancelling slots are coated as a result. To be more compatible with microfabrication limitation, the altered design in FIG. 15 is proposed and developed. In this design, two sets of silicon walls are added to the structure to prevent gold deposition on the main silicon block and the reflection-cancelling slot. As shown in the figure, since the air gap is very thin (<3~5 μm) and the aspect ratio is high, the walls are not metal-coated during metal deposition. In addition, the reflection cancelling slot is covered with a block which will be metal-coated later and makes it capacitive. Since the radiating slot is inductive, the distance between the two ($l_r$) should now be a modulus $\lambda_{g0}/2$ to cancel the reflection. The dimensions of the slot and the blocks are optimized in Ansoft HFSS to minimize the reflection loss at the center frequency. The Directivity and return loss are shown FIG. 16.

E. The Final Design

The final antenna structure and the radiation pattern in the azimuth direction are shown in FIGS. 17A and B. It is noticeable that the main beam is steering from −240 to +260 by changing the frequency from 230 GHz to 245 GHz. The scan angle for different frequencies is listed in Table 2.

TABLE 2

Different scan angles versus frequency to verify frequency scanning.

| Frequency | Scan angle | Directivity |
|---|---|---|
| 230 GHz | −24 deg | 26.73 dB |
| 235 GHz | −8 deg | 29.83 |
| 237.5 GHz | 0 deg | 29.87 |
| 240 GHz | 8 deg | 29.55 |
| 245 GHz | 26 deg | 26.12 |

II. Micromachining and Transitions

In recent years, the submillimeter-wave (SMMW) and terahertz (THz) frequency spectrum of electromagnetic waves have received significant attention due to their applications in wideband secure communication, environmental and biomedical sensors, as well as miniaturized radar-based navigation and imaging systems. Since the wavelength in this band is rather small, compact and fully integrated circuits on a single chip or wafer can be realized. For such circuits, devices and components compatible with planar and 2.5D structures are of interest. Losses in planar transmission lines at millimeter-wave frequencies and above can impair the performance of integrated antenna arrays with corporate feed structures or the performance of filters (insertion loss and frequency selectivity) realized on such transmission lines. As an alternative, often times rectangular waveguides are utilized for the antenna feed and filter designs to avoid the high Ohmic and dielectric losses of planar transmission lines.

Active components and devices such as amplifiers, mixers, and multipliers are most conveniently fabricated and integrated on planar transmission lines. To connect such devices to antennas, appropriate transitions from these transmission lines to waveguides are needed. At high MMW and low THz frequencies, waveguide structures can be directly fabricated on silicon or glass wafers using micromachining methods allowing for fully integrated system to be fabricated on a single wafer. Micromachining is also a preferable approach at these frequencies as it offers the required fabrication tolerances and can eliminate the need for assembling different parts and components. Various microstrip or coplanar waveguide—(CPW) to-rectangular waveguide transitions have been proposed in the past at X- and Ka-bands, fabricated using standard machining techniques. Many of these techniques, however, cannot be adopted for micromachining as they require multiple parts with complex 3-D geometries and/or different dielectric materials in their construction. The literature concerning microfabrication of waveguide structures at W-band and higher is rather sparse. There have been several attempts to fabricate W-band waveguides with low-cost microfabrication techniques such as lithography. However, in these techniques, the height of the waveguide is limited by the maximum thickness of the spun photoresist, limiting the fabrication to reduced-height waveguides, which suffer from high attenuation. Taking advantage of the "snap-together" technique, a rectangular waveguide was fabricated in two halves and then the halves were put together to form a complete waveguide. An alternate technique for etching the waveguide is deep reactive ion etching (DRIE) of silicon which is a viable approach for fabrication of high-performance micromachined waveguide structures. In some cases, transitions using microfabrication processes, but with separately fabricated and assembled probes, have been reported for both diamond and rectangular waveguides showing 20% bandwidth. Another high-precision silicon micromachined transition with the capability to integrate filters has been proposed and shows wideband characteristics at the same frequency range. However, these transitions involve a high degree of fabrication complexity, complex three-dimensional geometries, assemblies of various parts, and a high number of steps needed for construction which cannot be easily implemented in MMW and sub-MMW frequency bands.

According to the principles of the present teachings, we propose an in-plane transition from cavity-backed CPW (CB-CPW) line to rectangular waveguides compatible with silicon microfabrication techniques that does not require assembly of multiple parts. In this approach, the need to fabricate a suspended resonant probe is eliminated and an effective wideband transition is achieved using two different resonant structures, namely, shorted CPW line over the broad wall of the waveguide followed by an E-plane step discontinuity. A prototype of this transition at Ka-band has been previously fabricated using standard machining methods and measured to validate its performance. The structure is designed to be very simple with all its features aligned with the Cartesian coordinate planes in order to make it compatible with microfabrication processes. The transition is modeled by an equivalent circuit to help with the initial design which is then optimized using a full-wave analysis. A back-to-back structure for standard WR-3 rectangular waveguides is microfabricated on two silicon wafers which are bonded together using gold-gold thermocompression bonding technique (a hermetic bond) to ensure the excellent metallic contact needed for the formation of the waveguide. The validity of the transition design is demonstrated by measuring the S-parameters of a 240 GHz back-to-back transition prototype using a vector network analyzer with frequency extenders connected to WR-3 GSG probes. The measured results show a very good agreement with the simulations.

A. Micromachining Design Constraints

Traditional CPW to rectangular waveguide transitions based on E-plane probe excitation involve attaching a suspended resonant probe to the center conductor of a CPW line going through the broad wall of the waveguide as shown in FIG. 18A. This transition covers the waveguide band and can easily be fabricated at microwave and low MMW frequency bands using the standard fabrication and assembly methods. At high MMW and THz frequencies where the tolerance of standard machining methods are not sufficient, micromachining techniques can be used. Although micromachining can provide the required tolerances for fabrication of small and high precision devices, there are many limitations on what can be fabricated. For example, structures that are 2.5D (prismatic structures) are simple to fabricate. Also structures formed by stacking wafers with 2.5D geometries are possible. However, microfabrication of a very small suspended probe within a hollow waveguide patterned in a silicon wafer is rather challenging. In some cases, using non-contact lithography, the CPW line is patterned after etching the suspended probe. However, the process of spinning photoresist uniformly in the presence of the probe is very challenging. Alternatively, if the CPW is patterned first, the surface cannot be etched afterward to construct the probe and also attaching a suspended probe to wafer in the final step is not practical due to its small dimensions.

The microfabrication of a transition can be performed conveniently using two stacked wafers, if a short-circuited probe extending the entire height of the waveguide is used. The waveguide trench and the probe are patterned and etched on one substrate while the CPW line is patterned on another substrate as shown in FIG. 18B which are eventually bonded together. Nonetheless, a short-circuited probe acts purely reactive and cannot be matched to the CPW line. To properly excite a waveguide with this probe, a resonant condition must be achieved to eliminate the probe reactance. It is well-known that a pin terminated by the broad wall of a rectangular waveguide acts as an inductive element whose inductance is inversely proportional to its diameter and the waveguide dimensions. To compensate for the inductance of the shorting pin Xp, a capacitive element is needed. Since a step discontinuity in the E-plane of the waveguide acts as a capacitive element, it can be used to compensate for the inductive behavior of the pin. That is, a resonant condition can be realized by terminating a short-circuited pin in a reduced-height waveguide with a step transition from the reduced-height waveguide to the standard-size waveguide. The length of the waveguide between the pin and the step transition can be used to control the capacitance seen by the inductance. Also, the waveguide height can be used to control the capacitance at the step transition point.

B. Transition Designs

Cavity-Backed CPW to Rectangular Waveguide Transition

CBCPW lines are preferred at very high frequencies for mounting active components due to their low-loss characteristics. Hence, a transition from a novel low-loss membrane supported CBCPW (FIG. 19) to rectangular waveguide is considered here. In CBCPW structure the dielectric substrate is removed and the line is suspended over a hollow trench in order to eliminate the dielectric loss. For fabrication purposes, a dielectric membrane on top of the line supports the suspended line over the trench. This line can be easily incorporated with hollow rectangular waveguides.

The proposed transition is presented in FIG. 20A. Unlike the previously microfabricated transitions, the CBCPW line is positioned in-plane with the waveguide top wall and can be easily fabricated using two stacked silicon wafers. The CPW line printed over the top waveguide wall is given different characteristic impedance in order to create a transmission line resonator including the pin. This second resonator that is coupled to the pin and step resonator inside the waveguide provides another impedance match. The center conductor of the CPW line is open-circuited at the location of the pin and the pin is connected to the lower wall of a reduced-height waveguide. On the other side of the pin, the reduced-height waveguide is short-circuited at a distance to appear as another reactance parallel to the pin inductance.

To design the transition, first the dimensions of waveguide and CBCPW line are chosen based on the desired frequency range. The initial values of elements of the circuit model are selected using the analytical formulas and measurement results reported elsewhere. These values along with the length of waveguide and CPW line sections are optimized using transmission line analysis of the circuit model to obtain the resonant behavior. A structure based on these values is designed and then optimized a using full-wave simulator (Ansoft HFSS).

The electric field distribution and the reflection coefficient of the optimized structure are represented in FIG. 20B and FIG. 19 for the back-to-back transition. It is shown that transition with a transmission coefficient better than −1.5 dB over 17% fractional bandwidth can be achieved.

C. Grooved CPW to CBCPW Transition

The low-loss CBCPW line is suspended on a membrane and hence, measurement probes cannot be placed on it since even a small amount of pressure applied by the probes might break the membrane. On the other hand, conventional CPW has dielectric substrate and is stiff enough for the probes pressure which makes it more convenient to use for measurement purposes. Hence a transition from a conventional CPW to CBCPW is required to characterize the performance of a back-to-back transition. The proposed structure is shown in FIG. 22. For the ease of fabrication and lower loss, a grooved CPW is designed. The substrate is made of silicon and loss tangent is calculated based on the resistivity of silicon wafer. It should be noted that the response of this transition is eventually de-embedded from the final measured results.

The final fabricated structure is a back-to-back configuration from grooved CPW to CBCPW to reduced height waveguide to standard-height waveguide.

D. Integration of Active Components

Although the main objective of this paper is to present the design and fabrication of CBCPW to waveguide transition, it is also useful to discuss the approach for integrating non-silicon based active devices in such transitions. This can be done from the topside using capacitively-coupled flip chip method. At high MMW and sub-MMW frequencies allowing small overlap areas (as small as 250 μm×750 μm) of metallic traces of CPW lines on the chip and the transition with air-gaps as high as 5 μm are sufficient for very good electric coupling between the chip with active components and the CBCPW line. To simplify the alignment issues a hole in the bottom wafer with approximate dimensions of the chip created through which the chip can be guided and come in contact with the metallic traces of the transition CPW lines as show in FIG. 21.

E. Sensitivity Analysis

Despite high level of accuracy, micromachining with multiple fabrication processes as shown above is prone to errors caused by small misalignments, as well as geometrical distortions resulted from lithography and DRIE etching. Etching silicon very deep (~432 μm) with uniformity and high precision over large areas is rather difficult. The etch rate in the DRIE chamber might vary depending on the temperature, the position of the feature on the wafer, RIE lag effect, etc. As a result, it is most likely that the required etch depth values are not very precise. Hence it is essential to examine the sensitivity of the structure to the fabrication tolerances. For the nominal values of the WR3 and reduced height waveguide depths ($h_{WG}$=432 μm and $h_2$=159 μm as shown in FIG. 20), a maximum error of about ±20 μm might be expected for different DRIE runs of depth higher than 400 μm. FIGS. 23A and B shows the simulated S-parameters for different values of $h_{WG}$ and $h_2$. It is shown that errors as high as 20 μm (5%) in $h_{WG}$ do not perturb the bandwidth and insertion loss of the transition from its nominal values considerably. For $h_2$ however, we need to maintain the error within ±5 μm which is quite achievable. Experimental results on over 10 wafers etched with this method show that the error always remained less than 5 μm deviations.

Mechanical robustness of gold bonding has been verified by dicing and examining the bonded wafers at multiple locations. Visual inspections and mechanical tests trying to separate the segments of bonded wafers all indicated very high quality gold-to-gold bonding. As mentioned before the wafer bonding process had to be done after the top wafer was patterned and etched. One concern here is the lack of pressure over areas where silicon was etched away. One of these critical areas is the point where the shorting pin on the bottom wafer must be connected to the center conductor of the CBCPW line on the top wafer. Fortunately a relatively good electric contact can be established between the pin and the CBCPW center conductors. This is verified by measuring the ohmic resistance between signal and ground. To investigate performance degradation in case of weak gold bonding over the pin, simulations are carried out allowing a small gap between the pin and the center conductor. FIGS. 23C and D represents how much the transmission and reflection coefficients are affected in case the pin is not electrically connected to the top wafer. The results show that the gap size values below 3 μm, does not affect the S-parameters significantly. For the actual structure, since the membrane does not have a considerable amount of stress and does not buckle, a gap larger than a micron is not expected.

F. Measurement Results

In order to de-embed the effect of the grooved CPW line in the measured S-parameters, calibration standards for the designed lines are required. Since it is not feasible to design matched loads for the line, the TRL (through-line-reflect) technique is chosen to calibrate the system. A set of through and half wavelength lines along with a short line is used. These lines include the grooved CPW to CBCPW transition as well and the fabricated set is shown in FIG. 24.

S-parameter measurement of the transition is performed using a dual source PNA-X with OML frequency extenders as shown in FIG. 25. The structure is fed using GSG probes connected to the frequency extending modules using WR-3 bent waveguides controlled by Cascade Microtech MMW micropositioners. On-substrate TRL calibration lines are measured first to de-embed the effect of grooved CPW line. After calibration, S-parameters of the back-to-back transition are measured and presented in FIG. 26. The measurement results show a good agreement with the simulation. Measuring over five different samples on one wafer—which have consistent alignment and thermocompression boding conditions—shows similar minor deviations from the simulation. Therefore, the deviation can be mainly attributed to the error in the probe placement and establishing good contacts on the pads. It should be emphasized that the measured transmission loss includes the loss for the back-to-back transition as well the segment of waveguide in between. The transmission loss associated with one transition is therefore less than 0.6 dB over 220-260 GHz.

III. Microfabrication Process

The fabrication of the antenna structure is performed on three silicon wafers which henceforth will be referred to as bottom, top, and third wafers. The bottom wafer includes the meandered waveguide, multi-step structure, the short-circuited pin and, the CBCPW and CPW grooves. The top wafer includes the membrane and the gold patterns of slots, CBCPW and CPW. These gold-coated wafers are ultimately attached using gold thermocompression bonding technique. The third wafer includes the patch array pattern and will ultimately be bonded to the first pair (top and bottom wafers) using Parylene bonding.

A. Bottom Wafer

A multi-stage approach for etching silicon wafer using DRIE method is developed to fabricate the stepped structure of CBCPW and waveguide. Unlike wet etchants which etch silicon anisotropically along the crystal planes, DRIE is used to create deep, steep-sided holes and trenches in wafers. This approach allows creation of trenches and groove with aspect ratios as high 20:1 or more.

Figure 28C:
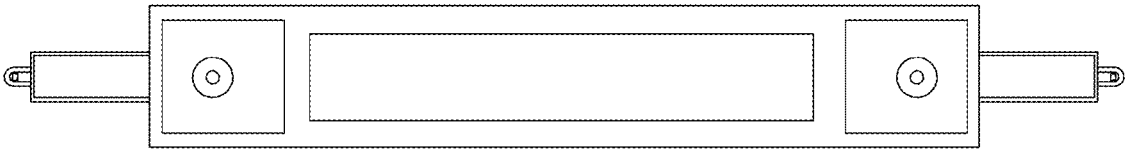

To create a multi-step structure on a silicon wafer, multi-step masking, pattering, and etching will be required. In this process, the wafer is patterned successively with different mask materials. Then it is etched with the last mask to the desired depth, the mask is removed and etching is continued with the next mask to the desired depth for the next step. This process can be carried on to achieve different steps of different depth within the silicon wafer. The fabrication process is illustrated in FIG. 27. By carefully managing etching time and thickness of the mask layers, a consistent process can be achieved. FIGS. 28A and B shows the microscopic image of the fabricated three-step structure before and after etching on low-resistivity silicon wafers (0-100 Ω·cm). FIG. 28C shows the image of the fabricated back-to back structure.

Figure 29A:
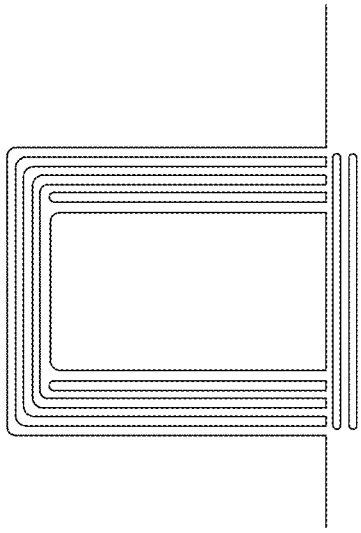

One difficulty in the fabrication of the grooved CPW and the CBCPW on the same wafer pertains to the fact that the bottom wafer on which the cavity of CBCPW and the grooved CPW are to be fabricated must be metalized by gold, however, the grooves of the CPW cannot be metalized or otherwise the CPW will be short-circuited. Also, the backwall of the grooved CPW shown in FIG. 22B should not be gold-coated. In order to protect these areas from gold deposition, patterning is found to be practically impossible as was initially envisioned. To overcome this problem, we developed a technique utilizing the fact that gold deposition is not possible within very narrow grooves with very high aspect ratios. We have experimentally shown that when the width of a trench is less than 5 μm and the aspect ratio is higher than 10, gold is not deposited on the bottom and lower portion of the side walls of the trench. To fabricate the structure of FIG. 29B without groove metallization, the geometry shown in FIG. 29A is proposed. In this structure the thin protecting walls shadow gold deposition because of the high aspect ratio of the channels. The walls will be eventually removed by dry silicon etching.

Figure 29B:
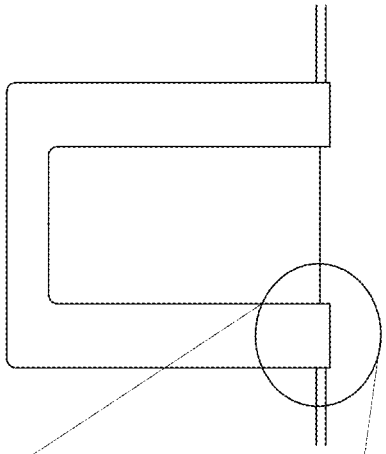
Figure 29C:
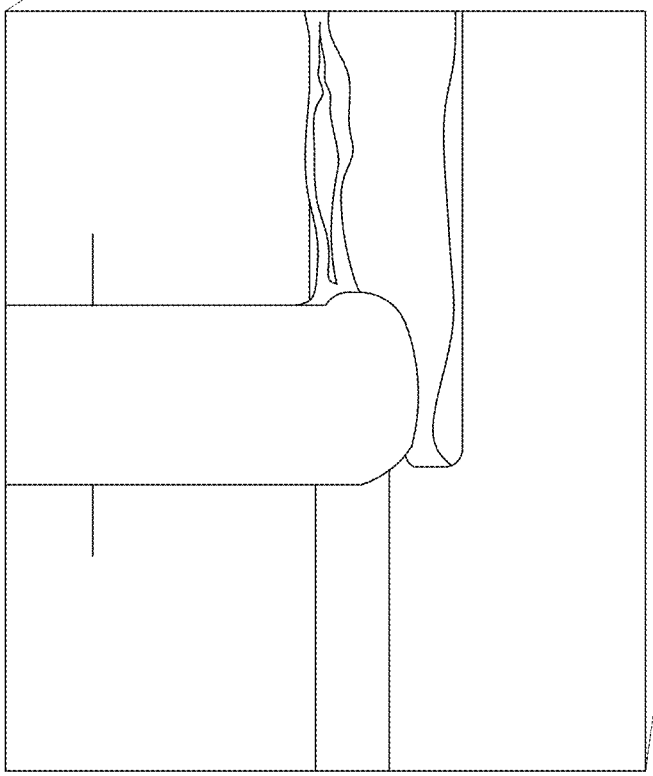

After the wafer is etched, a layer of silicon oxide is deposited as a diffusion barrier before gold-coating the surface. This layer is needed for gold bonding to stop diffusion of silicon through the gold layer during bonding. Then titanium or a combination of chrome and titanium with thicknesses of 300~500 Ao is deposited as the gold adhesion layer. Due to around 50% step coverage, gold thickness of 1~1.5 μm is needed in order to ensure at least 0.5~1 μm of gold is deposited on the sidewalls. At the final step, the thin shadow walls in the CPW grooves are removed using an isotropic silicon etchant. The etch time depends on the gap width between the walls and is longer for thinner and deeper gaps as it is hard for the gas to penetrate inside these areas. However, in order to reduce damage to other areas, the wafer was exposed to the etchant over a relatively short period of time to make the walls frail. Ultrasonic vibration is then used to remove the fragile walls completely as shown in FIG. 29B. It is observed that the walls are completely removed after 5 min of exposure to XeF2 and 2 minutes of ultrasonic vibration. FIG. 29C shows the SEM image of the end wall of the grooved CPW (tilted 20° for a better view of the backwall) which verifies that the shadow walls prevented gold deposition over the vertical walls of the middle silicon block.

B. Top Wafer

A second wafer is used to cover the top part of the waveguide structure. On this wafer, first a stacked layer of LPCVD SiO2/Si3N4/SiO2 membrane is deposited. This three-layer membrane is chosen to minimize stress so that the membrane does not buckle after the top silicon is removed. At the next step, the wafer is coated with gold which is patterned and etched with the mask of the grooved CPW, CBCPW and narrowed CBCPW lines. In order to suspend the center conductor of CBCPW on the membrane, backside of the wafer is etched on the areas around the CBCPW line. FIGS. 30A and B shows the fabrication process of the top wafer and FIG. 30C represents the fabricated top wafer.

C. Bonding

As the final step, the top and bottom wafers are bonded using gold-to-gold thermocompression bonding process. The bonding requires a high-force on a surface with a high temperature; around 400° C. but much lower than gold melting point. Before bonding, the wafers must be aligned carefully. Since in certain areas over the top wafer silicon is removed and the membrane is transparent, the bottom wafer can be seen easily and markers can be used for precise alignment. This method provides much higher precision bond-aligning compared to the backside alignment technique.

After aligning and clamping the wafers together, they are placed inside the bonding chamber, and a pressure of 4000 torr and temperature of 3750 c is applied for 40 minutes. FIG. 31 shows the top view of the structure after bonding. It is observed that the quality of gold does not degrade after bonding due to the utilization of a high quality diffusion barrier layer. FIG. 31B shows the full view of the final structure and a large open area where the back side of the center conductors of the grooved CPW lines are observable. This open area allows easy placement of the GSG probes. The bond-alignment error is maintained below 5 μm among different samples.

D. Third wafer-Patch Array

The patch array structure consists of 36×2=72 (two in each turn) seven-element patch sub-arrays. The array has to be suspended over a membrane on top of air substrate. Therefore, a membrane with high elasticity is required for this long and wide area. Initially, stacked layer SiO2/Si3N4/SiO2 (ONO with 1 um thickness) and SU-8 photoresist (with 5 um thickness) were tested as membranes. In these processes, the membrane layer is first deposited on a silicon wafer. Then gold is deposited and etched with the mask of patch arrays. Then this wafer had to be bonded to the second wafer (the top wafer). After bonding, silicon of the third wafer should be removed to have the patches suspended on the membrane. For this purpose, both wafer release and wafer etching techniques can be used. For wafer release, a release layer such as photoresist should be used before the membrane layer. However, releasing wafer involves a wet etching process after bonding which cannot be used due to penetration of the solvent to the bottom layers. Dry etching of the whole wafer did not work either since the etching is not uniform. It attacks the edges and areas around the circumference of the wafer strongly. The only other way is removing the top wafer locally only around patch areas using DRIE.

The choice of bonding method is flexible since we do not need a high quality adhesion. If the membrane is ONO, diffusion or anodic bonding can be used. However, ONO layer cannot be suspended over a large area. SU-8 photoresist cannot be used since the temperature cannot go higher than 1500 C (which causes cracks in SU-8 layer) so a low temperature bonding method should be used. One way is to use a photo-patternable glue applied on the wafers. Unfortunately, such a material cannot be easily found. Photoresist is the only known choice but it outgases and losses its adhesive properties when it is placed inside the DRIE chamber. Crystalbond LT which is used for temporarily mounting in microfabrication was another option. The material cannot be spun or patterned, it has to be applied manually and therefore the thickness cannot be controlled which causes the gap between patches and substrate. However, since the adhesive properties are very good, it was used to test the SU-8 membrane and proved that in fact SU-8 is not a good choice for membrane either. Since the wafer removal process was etching, the membrane collapses around the edges, while silicon is still left around the center. SU-8 layer could be more efficient if the wafer removal process could be improved.

Using polymer bonding techniques with a polymer membrane is another option. To test this method, Parylene is used. Also, in order to avoid all the problems we experienced for removing the third wafer after bonding, membrane transfer technique is used.

The fabrication process is explained in FIG. 32. First, a layer of a photoresist (as a release layer) is spun on the unpolished side of a silicon wafer and baked. The reason for using the unpolished side is to decrease adhesion of the Parylene layer to silicon. A layer of Parylene with 5~15 um thickness and then gold with Titanium as the adhesion layer are deposited at the next step. Gold is patterned with the patch array mask. At the last step, we make some cuts around the circumference of the wafer to provide access to the bottom photoresist layer. The wafer is soaked in acetone and then IPA (isopropyl alcohol) solutions for a couple of days to dissolve the photoresist completely.

The gold-bonded pair should also be covered with Parylene for Parylene bonding. Since the adhesion of polymers to gold is poor, a thin layer (around 300 Å) of Titanium (or Chrome) is used on top of gold for better adhesion to Parylene. Since the thickness is 300 Å (0.03 um) which is much smaller than the Ti skin depth (0.65 um), it does not affect the loss of the patch arrays. The wafer is covered with Parylene next. A shadow mask can be used to etch Parylene from the substrate so that we are left with a layer around the patches for bonding to patch wafer.

Parylene bonding is performed under 800N/wafer area pressure and 150+° C. temperature for 30 minutes under vacuum in order to avoid Parylene interaction with oxygen and nitrogen at high temperature. These values may not be consistent for different samples since the heat transfer might vary depending on the total thickness of the structure. To overcome this issue, the bonding time should increase. Another method is to increase the temperature. However, at high temperatures, even though bonding quality is better, the elasticity of Parylene is decreased causing brittle membranes. The patch wafer is less likely to attach to Parylene after dissolving photoresist and the unpolished side of silicon wafer decreases the chance of bonding silicon and Parylene at high temperature and pressure. After bonding, a razor blade is used to cut Parylene from the circumference of the patch wafer. Then the patch wafer can be easily de-bonded and released from the substrate with the Parylene membrane suspended on top of the substrate. Since the Parylene from the patch wafer is connected to the bottom Parylene wafer, this method is called the Parylene transfer method. The final fabricated structure is shown in FIG. 33.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A frequency scanning antenna array comprising:

a rectangular waveguide having an array of slots formed on a wall of the rectangular waveguide serving as radiating elements operating at millimeter or smaller wave frequency, wherein said antenna array provides about 2° beam width in an azimuth direction and about 30° beam width in an elevation direction and is frequency scanning from −25° to +25 °, wherein said rectangular waveguide is a micro-machined meander waveguide having dispersive properties that permit beam scanning by stepping in frequency.

2. The frequency scanning antenna array according to claim 1 wherein said array of slots are micro-machined into said meander waveguide, said array of slots radiating an input signal within said meander waveguide as an output beam outside said meander waveguide.

3. The frequency scanning antenna array according to claim 2 wherein said array of slots radiates said output beam at a power and phase distribution sufficient to achieve a predetermined narrow beam in a predetermined direction at a predetermined frequency.

4. The frequency scanning antenna array according to claim 2, further comprising:

a linear patch array operably coupled to said array of slots, said linear patch array controlling said output beam to a fixed beam in elevation.

5. The frequency scanning antenna array according to claim 4 wherein said linear patch array comprises an odd number of element, wherein a center patch of said linear patch array is fed by a center slot of said array of slots and the remaining patches of said linear patch array are fed in series from said center patch.

6. The frequency scanning antenna array according to claim 1 wherein said micro-machined meander waveguide comprises a plurality of bends, a reflection of each of said plurality of bends is minimized at a center frequency and a cumulative reflection of all of said plurality of bends is minimized at the beginning and the end of the frequency band such that the overall reflection is maintained below −20 dB throughout the entire frequency band.

7. The frequency scanning antenna array according to claim 2, further comprising:

a reflection cancelling slot disposed in said meander waveguide, said reflection cancelling slot being positioned at a quarter wavelength distance from one of said array of slots, said reflection cancelling slot providing an in-phase reflection operable to cancel a reflection from said one of said array of slots.

8. The frequency scanning antenna array according to claim 4 wherein said array of slots is non-resonant and becomes resonant once said linear patch array is operably coupled thereto.

9. The frequency scanning antenna array according to claim 4 wherein each of said array of slots is positioned transverse to a direction of propagation in said rectangular waveguide to permit coupling to said linear patch array oriented in said direction of propagation thereby resulting in a narrow beam in an elevation direction.

10. The frequency scanning antenna array according to claim 4 wherein said micro-machined meander waveguide comprises a plurality of bends and interconnecting portions interconnecting said plurality of bends, each of said interconnecting portions having at least two of said slots, an inter-element spacing between adjacent linear patch arrays being less than half a wavelength to suppress grating lobes in an azimuth direction.

11. The frequency scanning antenna array according to claim 4 wherein said micro-machined meander waveguide comprises a plurality of bends and interconnecting portions interconnecting said plurality of bends, each of said interconnecting portions having at least two of said slots, a size of said at least two slots increasing along said waveguide to control the coupling level and to achieve a predetermined field aperture distribution.

12. The frequency scanning antenna array according to claim 2, further comprising:

a transition system operably coupling a radar transmit module and a radar receive module to said rectangular waveguide, said transition system transmitting said input signal.

13. The frequency scanning antenna array according to claim 12 wherein said transition system comprises:

a short-circuited pin extending along a broad wall of said meander waveguide and a step discontinuity in said waveguide.

14. The frequency scanning antenna array according to claim 12 wherein said transition system comprises:

a thru-wafer transition for mounting non-silicon-based active devices to generate said input signal.

15. The frequency scanning antenna array according to claim 1 wherein said waveguide comprises:

a lower portion; and an upper portion, said lower portion and said upper portion defining a meandering cross-section.

16. The frequency scanning antenna array according to claim 15 wherein said lower portion and said upper portion are made via deep reactive ion etching (DRIE).

17. The frequency scanning antenna array according to claim 15 wherein said lower portion is bonded to said upper portion using gold-to-gold thermocompression bonding.

18. The frequency scanning antenna array according to claim 2 wherein said meander waveguide comprises a first wafer being joined to a second wafer, said first wafer having an etched portion of said meander waveguide formed thereon, said first wafer having a first thickness, said second wafer having said array of slots extending therethrough, said second wafer being coupled to said first wafer to form a top portion of said meander waveguide, said second wafer having a second thickness, said second thickness being less than said first thickness;

said frequency scanning antenna array further comprising a third wafer coupled to said second wafer, said third wafer having a membrane deposited thereon, a metallic linear patch array being patterned along said membrane.

19. The frequency scanning antenna array according to claim 5, further comprising:

a silicon post facilitating coupling from said center slot of said array of slots to said center patch of said linear patch array.

* * * * *